US005298947A

United States Patent [19]

Aono et al.

[11] Patent Number: 5,298,947

[45] Date of Patent: Mar. 29, 1994

[54] PROCESS FOR RECORDING IMAGES ON AN ELECTROSTATIC INFORMATION RECORDING MEDIUM WITH DELAYED DISCONNECTION OF CHARGE ACCUMULATION VOLTAGE

[75] Inventors: Takashi Aono; Minoru Utsumi; Hiroyuki Obata; Kohji Ichimura; Masayuki Iijima, all of Tokyo, Japan

[73] Assignee: Dai Nippon Printing Co., Ltd., Tokyo, Japan

[21] Appl. No.: 720,858

[22] PCT Filed: Nov. 16, 1990

[86] PCT No.: PCT/JP90/01497

§ 371 Date: Jul. 16, 1991

§ 102(e) Date: Jul. 16, 1991

[87] PCT Pub. No.: WO91/07702

PCT Pub. Date: May 30, 1991

[30] Foreign Application Priority Data

| | | | |
|---|---|---|---|
| Nov. 16, 1989 | [JP] | Japan | 1-298391 |
| Dec. 22, 1989 | [JP] | Japan | 1-333078 |
| Dec. 28, 1989 | [JP] | Japan | 1-342248 |
| Jul. 12, 1990 | [JP] | Japan | 2-186021 |
| Jul. 12, 1990 | [JP] | Japan | 2-186022 |
| Jul. 12, 1990 | [JP] | Japan | 2-186023 |

[51] Int. Cl.[5] ..... G03G 15/00; G03G 5/00

[52] U.S. Cl. ..... 355/211; 355/217; 365/112; 430/48

[58] Field of Search ..... 355/210, 211, 217, 219; 430/48, 54, 127

[56] References Cited

U.S. PATENT DOCUMENTS

| | | | |
|---|---|---|---|
| 3,653,890 | 4/1972 | Seimiya et al. | 430/48 |
| 3,730,710 | 5/1973 | Ohta . | |
| 3,963,488 | 6/1976 | Brushenko | 430/54 |
| 4,023,895 | 5/1977 | O'Brien | 355/217 |
| 4,050,804 | 9/1977 | Silverberg | 355/211 X |
| 4,207,100 | 6/1980 | Kadokura et al. | 355/217 X |
| 4,628,017 | 12/1986 | Tagoku | 430/48 |

FOREIGN PATENT DOCUMENTS

| | | |
|---|---|---|
| 49-10703[B] | 3/1974 | Japan . |
| 52-142841[U] | 10/1977 | Japan . |
| 53-86224 | 7/1978 | Japan . |
| 54-115139 | 9/1979 | Japan . |
| 61-110165 | 5/1986 | Japan . |

*Primary Examiner*—Joan H. Pendegrass
*Attorney, Agent, or Firm*—Dellett and Walters

[57] ABSTRACT

The present invention provides an image-recording process wherein the voltage applied between a photosensitive member 2 and electrostatic information recording medium 1 is put off after the lapse of a given time from the closing of an exposure shutter 13. It is thus possible to move all the generated carriers onto electrostatic information recording medium 1 and accumulate them as charges in an amount corresponding to the quantity of exposure irrespective of a voltage shutter time. It is also possible to electrically charge electrostatic information recording medium 1 or the photosensitive member 2 in advance and put on-off an electrical connection between the electrodes of the photosensitive member 2 and electrostatic information recording medium 1 to control image exposure, thereby dispensing with any external high voltage power source and obtaining a positive image. In addition, it is possible to avoid the occurrence of inverse discharge and prevent the resulting image from falling into disorder by separating the photosensitive member 2 and electrostatic information recording medium 1 from each other, while voltage remains applied between the electrodes thereof, after an electrostatic image has been formed on the electrostatic information recording medium 1, and putting off the voltage impressed.

22 Claims, 21 Drawing Sheets

FIG. 5 (a) PRIOR ART
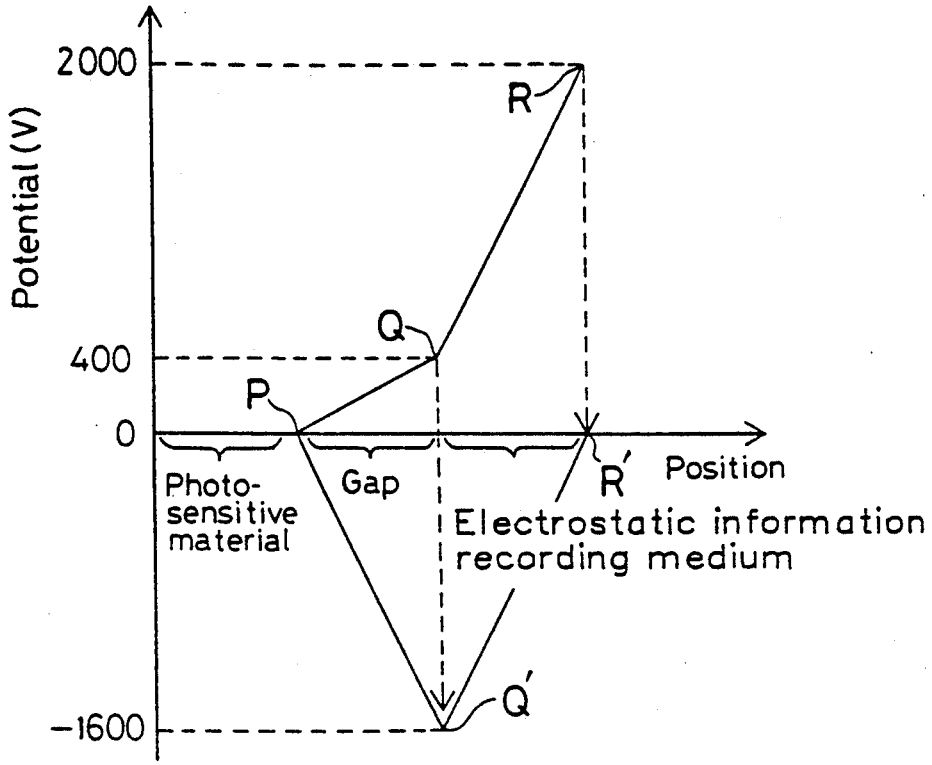
FIG. 5 (b) PRIOR ART
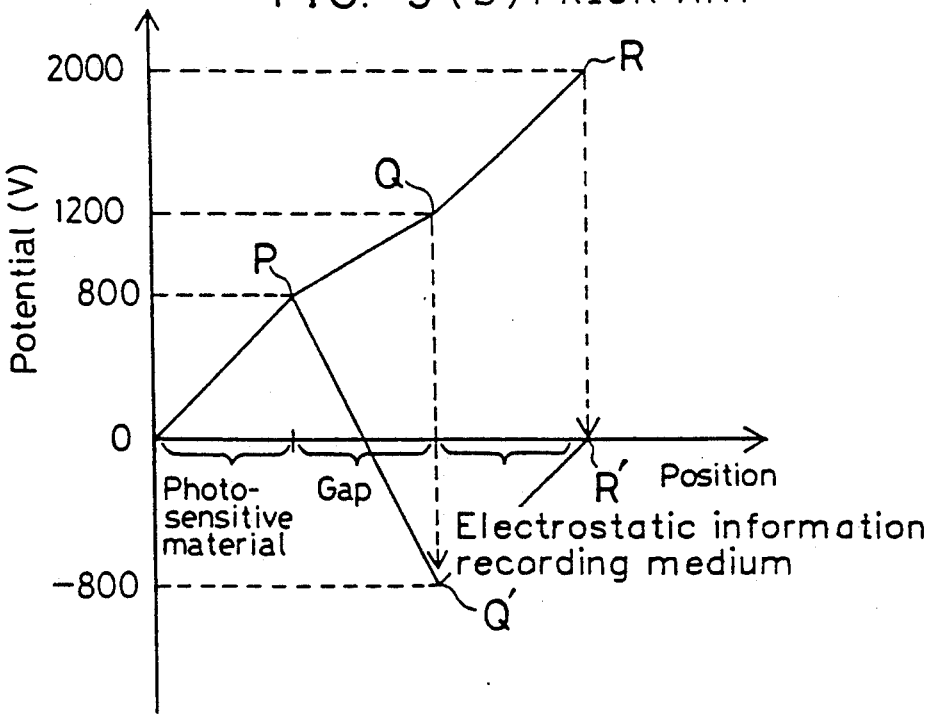

2---Photosensitive member
2a,1c---Substrate
2b,1b---Electrode layers
1---Electrostatic information recording medium
2c---Photoconductive layer
1a---Insulating layer
3---Spacer FIG. 15
(a)
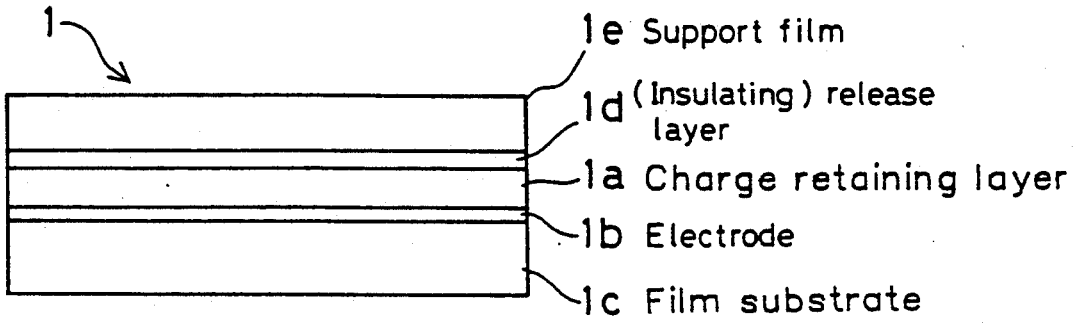
(b)
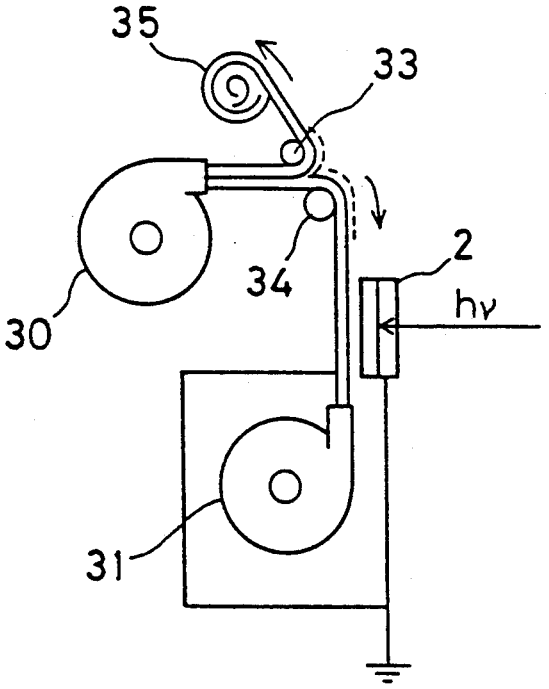

2a --- Substrate
2b --- Electrode layer
2c --- Photoconductive layer
3 --- Spacer 2a --- Substrate
2b --- Electrode layer
2c --- Photoconductive layer
3 --- Spacer 1c, 2a --- Substrate
1b, 2b --- Electrode layer
2c ---- Photoconductive layer
1a ---- Insulating layer
3 ---- Spacer 2a, 1c --- Substrate
2b, 1b --- Electrode layer
2c --- Photoconductive layer
1a --- Insulating layer
3 ---- Spacer

PROCESS FOR RECORDING IMAGES ON AN ELECTROSTATIC INFORMATION RECORDING MEDIUM WITH DELAYED DISCONNECTION OF CHARGE ACCUMULATION VOLTAGE

The present invention relates to an image-recording process for forming electrostatic latent images of high resolving power on electrostatic information recording medium, a system for carrying out such a process and a method for making such a device.

BACKGROUND OF THE INVENTION

As so far known in the art, there is available a process for recording and reproducing electrostatic images wherein "image exposure" is carried out with the application of voltage between both the electrodes of a photosensitive member and electrostatic information recording medium which are located in opposite relation to each other, thereby forming an electrostatic latent image of high resolving power on electrostatic information recording medium.

Such an electrostatic image-recording process is illustrated in FIG. 1, in which electrostatic information recording medium is shown at 1, a photosensitive member at 2, a photoconductive layer support at 2*a*, an electrode of the photosensitive member at 2*b*, a photoconductive layer at 2*c*, an insulating layer at 1*a*, an electrode of electrostatic information recording medium at 1*b*, an insulating layer support at 1*c* and a power source at E.

Referring to FIG. 1,. exposure is carried out through the photosensitive member 2. The photosensitive member 2 is constructed by providing the transparent electrode 2*b* formed of a 1000 Å thick ITO on the support 2*a* formed of a 1-mm thick glass and providing the photoconductive layer 2*c* of about 10 μm in thickness on the electrode 2*b*. The electrostatic information recording medium 1 is located in opposite relation to the photosensitive member 2 through a gap of about 10 μm. The electrostatic information recording medium 1 is formed by providing the A1 electrode 1*b* of 1000 Å in thickness on the insulating layer support 1*c* by vapor deposition and providing the insulating layer 1*a* of 10 μm in thickness on the electrode 1*b*.

As illustrated in FIG. 1*a*, electrostatic information recording medium 1 is first set with respect to the photosensitive member 2 through a gap of about 10 μm.

Then, voltage is applied between the electrodes 2*b* and 1*b* from the power source E, as illustrated in FIG. 1*a*. In the dark, no change will take place between both the electrodes, because the photoconductor 2*c* is a high resistant. However, when a voltage higher than the Paschen's discharge voltage is impressed to the gap depending upon the magnitude of the applied voltage or leakage currents from the substrate electrode, discharge takes place through the gap, forming electrostatic charges corresponding to the discharge on electrostatic information recording medium. When the photoconductive layer 2*c* is irradiated with light incident from the photoconductive layer support 2*a*, it generates photocarriers (electrons, holes) at the irradiated region, and charges opposite in polarity to the electrode of electrostatic information recording medium store through the photoconductive layer 2*c* toward its surface. In the meantime, as the proportion of voltage assigned to the air gap exceeds the Paschen's discharge voltage, corona discharge or field emission takes place between the photoconductive layer 2*c* and the insulating layer 1*a*, so that charges can be extracted from the photoconductive 2*c* and accelerated by the electric field, causing accumulation of the charges on the insulating layer 1*a*.

After the completion of exposure, the photosensitive member and electrostatic information recording medium are short-circuited, as shown in FIG. 1*c*. It is noted that while voltage supply has been described as put off by opening the switch, this may also be achieved by short-circuiting both the electrodes. Then, the electrostatic information recording medium 1 is removed, as shown in FIG. 1*d*, to complete the formation of an electrostatic latent image. By putting on off the voltage applied in this way or, in other words, using a voltage shutter, it is possible to form an electrostatic latent image; it is possible to dispense with such a mechanical or optical shutter as used with ordinary cameras.

The photoconductive layer 2*c* is an electrically conductive layer which, upon irradiated with light, generates photocarriers (electrons, positive holes) at the irradiated region, allowing such carriers to migrate in the widthwise direction. This layer may be formed of inorganic or organic photoconductive materials or their hybrids.

The inorganic photosensitive materials used may include amorphous silicon, amorphous selenium, cadmium sulfide, zinc oxide and so on.

The organic photosensitive materials used are broken down into single-layer and function-separated types.

The single-layer type of photosensitive material comprises a mixture of a charge-generating substance with a charge transport substance. As the charge-generating type of substances likely to absorb light and generate charges, for instance, use may be made of azo pigments, bis-azo pigments, trisazo pigments, phthalocyanine pigments, perylene pigments, pyrylium dyes, cyanine dyes and methine dyes. As the charge transport type of substances well capable of transporting ionized charges, for instance, use may be made of hydrazones, pyrazolines, polyvinyl carbazoles, carbazoles, stilbenes, anthracenes, naphthalenes, triphenyl-methanes, azines, amines and aromatic amines.

Referring to the function-separated type of photosensitive material, the charge-generating substance is likely to absorb light but has the property of trapping photocarriers, whereas the charge transport substance is well capable of transporting charges but less capable of absorbing light. For that reason, both the substances are separated from each other to make much use of their individual properties. For use, charge-generating and charge transport layers may be laminated. As the substances forming the charge-generating layer, for instance, use may be made of azo pigments, bis-azo pigments, trisazo pigments, phthalocyanine pigments, acid xthanten dyes, cyanine dyes, styryl dyes, pyrylium dyes, perylene dyes, methine dyes, a-Se, a-Si, azulenium salt pigments and squalenium salt pigments. As the substances forming the charge transport layer, for instance, use may be made of hydrazones, pyrazolines, PVKs, carbzoles, oxazoles, triazoles, aromatic amines, amines, triphenylmethanes and polycyclic aromatic compounds.

Referring here to the nature of the carriers generated, it is known that in the case of the inorganic photosensitive material, the mobility $\mu$ is high but the life time $\tau$ is short, whereas in the case of the organic photosensitive material, the mobility $\mu$ is low but the life time $\tau$ is long, with the product of $\mu\tau$ being nearly on the same level in both the cases. The formation of an electrostatic latent image by the "exposure with the application of voltage" may be achieved even by a mechanical exposure shutter or voltage shutter alone. However, with the mechanical exposure shutter alone, voltage remains impressed between the photosensitive material and the electrostatic information recording medium, This in turn poses 8 a problem that even when exposure is not carried out, dark currents flow, giving rise to dark potential.

When only the voltage shutter is used with the organic photosensitive material, on the other hand, there is a problem that the quantity of exposure and the amount of charges vary with a voltage shutter time. This will be explained in detail with reference to FIG. 2.

FIG. 2 is a graph showing the amount of charges on electrostatic information recording medium at a constant light intensity but at varied voltage shutter times, say, 0.01 second, 0.1 second and 1 second. In the case of the inorganic photosensitive material which has a high carrier mobility, the amount of charges corresponds to the quantity of exposure even at varied voltage shutter times, as can be seen from a characteristic curve A. On the other hand, the use of the organic photosensitive material results in a phenomenon that even at the same amount of exposure, there is a difference in the quantity of charges between the voltage shutter times 0.01 second and 0.1 second, and 0.1 second and 1 second, as can be seen from characteristic curves B. This is because the organic photosensitive material has a low carrier mobility; the carriers generated by exposure disappear, since the voltage is cut off before they reach the charge-carrying medium. Thus, there is a problem that even at the same quantity of exposure, the image potential varies with a voltage shutter time.

When the photosensitive member and electrostatic information recording medium are short-circuited, as illustrated in FIG. 3, so as to cut off voltage supply, increased inverse voltage is induced between the photosensitive member and the charge-carrying medium, causing re-discharge in the inverse direction. This will now be explained in detail with reference to FIGS. 4 and 5.

The photosensitive member, gap and electrostatic information recording medium are all considered to be capacitors, each of given capacitance, and if the photosensitive member and electrostatic information recording medium have the same thickness, dielectric constant and area, then both will have an equal electrostatic capacitance. Also, given a gap of about 12–13 $\mu$m between the photosensitive member and the electrostatic information recording medium, then the discharge voltage in the gap will be on the order of about 400V. For instance, now assume that the exposure with the application of voltage is carried out at an application voltage of 2000V. Then, the photosensitive member is made electrically conductive at the region exposed to light. Consequently, the overall "image exposure" system may be considered as an equivalent circuit in which, as illustrated in FIG. 4*a*, 400V and 1600V are applied to the capacitances C2 and C3 of the gap and electrostatic information recording medium, respectively. Similarly, the unexposed region may be taken as an equivalent circuit in which, as shown in FIG. 4*b*, 800V, 400V and 800V are applied to the capacitances C1, C2 and C3 of the photosensitive member, gap and electrostatic information recording medium, respectively.

Now consider potential distributions on the photosensitive member, and electrostatic information recording medium. For instance, it the electrode of the photosensitive member is defined as a reference position with a point P representing the end position of the gap, a point Q the end position of the gap and a point R the end position of the charge-carrying medium, then the distributions of potential on the exposed and unxposed regions are shown by P-Q-R in FIG. 5*a* and P-Q-R in FIG. 5*b*, respectively. This is because the photosensitive member is an electrical conductor.

When the photosensitive member and charge-carrying medium are short-circuited in such a state as shown in FIG. 5*a*, the point R is reduced to zero potential or a point R', and the point Q is reduced by the same potential difference or to a point Q', giving a potential distribution P-Q'-R'. Thus, a potential difference between P and Q', i.e., a voltage applied to the gap comes to 1600V.

This also holds for FIG. 5*b*; a potential difference between P and Q', i.e., a voltage applied to the gap comes to 1600V.

In consequence, the voltages applied to the respective capacitors are changed in state from FIGS. 4*a* and 4*b* to FIGS. 4*c* and 4*d*, respectively, in the equivalent circuit shown in FIG. 4. This poses a problem that an inverse voltage of 1600V that is much higher than the discharge voltage of 400V is so impressed on the gap that redischarge discharge can be instantaneously induced in the inverse direction, causing the recorded signals to fall into disarray and so rendering the dim image.

It is also well-known in the art to use a previously corona-charged, insulating layer film having an electrically conductive layer to form an electrostatic latent image thereon. To this end, exposure may be carried out while voltage is applied between the electrically conductive layer of the insulating layer film and the electrode of the associated photosensitive member, or both may be electrically short-circuited.

However, a problem with a conventional "image exposure with the application of voltage" process is that an external power source is needed to induce discharge by applying voltage between the photosensitive member and electrostatic information recording medium for exposure, only to render the system large in size and make the system likely to be affected by fluctuations in power source voltage.

If the previously corona-charged, insulating film is used, it may then be possible to dispense with using an external power source for exposure. Until now, however, nothing has been known about how to form latent images practically.

FIG. 6 is a diagrammatical sketch for illustrating a typical process, so far proposed, for recording electrostatic images with the use of a spacer.

Referring to FIG. 6, a photosensitive member 2—in which a transparent electrode layer 2*b* and a photoconductive layer 2*c* are successively laminated on the overall surface of a transparent substrate 2*a*—is located in opposite relation to electrostatic information recording medium 1—in which an electrode layer 1*b* and an insulating layer 1*a* are successively laminated on the overall surface of a substrate 1*c*—with a spacer 3 interposed therebetween. With voltage applied between both the electrode layers, the image exposure is carried out through, e.g. the photosensitive member 2. Then, the photoconductive layer 2*c* generates carriers at the exposed region and is made so electrically conductive there that discharge can take place at the exposed region between the photosensitive member and the electrostatic information recording medium, accumulating charges corresponding to the quantity of exposure on the insulating layer 1*a* and so forming an electrostatic latent image.

In the process for recording electrostatic images shown in FIG. 6, however, a variation of the gap length between the photosensitive member and electrostatic information recording medium causes changes in the field strength and hence the discharge current. This results in a change in the amount of charges accumulated on the insulating layer even in the same quanity of exposure. In order to obtain the amount of charges corresponding to the exposure energy therefore, it is required to keep the gap length constant. This is why the insulating spacer 3 has been inserted between the photosensitive member and electrostatic information recording medium every the image exposure to keep the gap length constant. In order to increase recording sensitity, it is then required to increase the amount of charges formed on the insulating layer 1*a* in the same exposure energy and it is necessary to this end to boost the voltage applied between the photosensitive member and electrostatic information recording medium. As the voltage increases, however, there is a problem that as when dust, etc. exist between the spacer and the photoconductive layer, discharge may take place at the spacer region, causing a breakdown of the photoconductive layer that is costly.

In addition, it is very awkward to interpose the spacer between the photosensitive material and electrostatic information recording medium to keep the gap therebetween constant, since the gap length is as short as a few tens microns. As a result, it is impossible to achieve high-speed image pickup continuously. Also, when the electrostatic information recording medium—in which electrostatic charge information has been carried—are put one upon another or rolled up—in this case, they should be flexible—for storage, there is a problem that the insulating layers may come into contact with the associated substrates, causing such information carried thereon to fall into disorder.

Usually, electrode layers are provided on the overall surfaces of the photoconductive material and electrostatic information recording medium with a spacer formed as of an insulating PET film provided between them to keep a discharge gap constant. However, when high voltage is applied on the spacer region or, especially when the spacer or its wall is bruised or otherwise flawed on the surface, surface currents flow through that spacer region, doing damage to the photosensitive member or electrostatic information recording medium and so causing their discharge breakdown. Once such discharge breakdown has occurred, the photosensitive member or the electrostatic information recording medium can never be used. Thus, the prior art poses a problem in connection with the service life of the photosensitive member or electrostatic information recording medium.

The present invention seeks to provide a solution to the above-mentioned problems.

SUMMARY OF THE INVENTION

One object of this invention is to obtain the amount of charges corresponding to the exposure energy irrespective of a voltage shutter time, even when an organic photosensitive member is used.

Another object of this invention is to prevent the occurrence of inverse discharge even when the voltage applied is reduced to zero after image-forming.

A further object of this invention is to obtain images of high accuracy with no need of using an high-voltage external power source.

A still further object of this invention is to enable a gap between a photosensitive member and electrostatic information recording medium to be easily kept constant.

A still further object of this invention is to prevent discharge breakdown from taking place through a spacer.

A still further object of this invention is to enable a discharge gas to be easily kept constant and to make high-speed photographing possible.

A still further object of this invention is to prevent discharge breakdown from occurring through a spacer, thereby increasing the service life of a photosensitive member and electrostatic information recording medium.

According to one aspect of the invention, there is provided an exposure process wherein a photosensitive member including a photoconductive layer on a support through an electrically conductive layer is located in opposite relation to electrostatic information recording medium including an insulating layer on a support through an electrically conductive layer, and image exposure is then carried out through the photosensitive member while voltage is applied between the electrically conductive layers of the photosensitive member and electrostatic information recording medium to accumulate charges on electrostatic information recording medium in an imagewise form, characterized in that the voltage applied between said electrically conductive layers is put off after the lapse of a given time from putting off said image exposure.

According to another aspect of the invention, there is provided an image-forming process wherein a photosensitive member including an electrically conductive layer and a photoconductive layer on a support is located in opposite relation to electrostatic information recording medium including an insulating layer on an electrically conductive layer, and image exposure is then carried out to form an electrostatic latent image on electrostatic information recording medium, characterized in that said photosensitive member or said electrostatic information recording medium has previously been charged to a given potential, and an electrical connection between both said electrically conductive layers is put on-off to control said electrostatic latent image.

According to a further aspect of the invention, there is provided a system for continuously or intermittently feeding a film type of electrostatic information recording medium including an insulating layer on an electrically conductive layer in opposite relation to a photosensitive member including an electrically conductive layer and a photoconductive layer on a support and carrying out image exposure to form an electrostatic latent image on the film type of electrostatic information recording medium, characterized by further including means provided on the side of feeding said film type of electrostatic information recording medium for electrically charging said electrostatic information recording medium and means for putting on-off an electrical connection between said electrically conductive layers of said electrostatic information recording medium and said photosensitive member at the time of said image exposure, thereby controlling said electrostatic latent image.

According to a still further aspect of the invention, there is provided a system including a turnable disc type of electrostatic information recording medium having an insulating layer on an electrically conductive layer and a photosensitive member including an electrically conductive layer and a photoconductive layer on a support, located in opposite relation there to carry out image exposure, thereby forming an electrostatic latent image on the electrostatic information recording medium, characterized by further including means for electrically charging said disc type of electorstatic information recording medium and means for putting on-off an electrical connection between said electrically conductive layers of said electrostatic information recording medium and said photosensitive member at the time of said image exposure, thereby controlling said electrostatic latent image.

According to a still further aspect of the invention, there is provided an image-recording process wherein a photosensitive member including an electrically conductive layer and a photoconductive layer on the surface of a support is located in opposite relation to electrostatic information recording medium including an electrically conductive layer and an insulating layer on a support, and image exposure is carried out with the application of voltage between the electrically conductive layers to form an electrostatic charge image on electrostatic information recording sodium, characterized in that after said electrostatic charge image has been formed on said electrostatic information recording medium, said photosensitive member is separated from said electrostatic information recording medium with the application of said voltage, thereby preventing inverse discharge from occurring in a gap between.

According to a still further aspect of the invention, there is provided a photosensitive member including an electrode layer and a photoconductive layer laminated successively on a substrate, characterized printing, or in that a patterned spacer is formed on said photoconductive layer, or said electrode is provided in a patterned form and said photoconductive layer is uniformly coated thereon and a spacer is provided on an electrode-free region of said photoconductive layer, or said electrode layer is provided in a patterned form and a spacer is provided on an electrode-free region, a region of said photoconductive layer, except said spacer portion, being formed on said patterned electrode layer with a thickness smaller than that of said spacer, or said electrode layer is uniformly formed on said substrate and a patterned spacer is formed on said electrode layer, said photoconductive layer being uniformly coated on a spacer-free region of said electrode layer with a thickness smaller than that of said spacer, or said electrode and photoconductive layers are coated on the bottom of a dent made in said substrate, the total thickness of said electrode and photoconductive layer laminated being smaller than the depth of said dent in said substrate, whereby a region of said substrate excluding said dent serves as a spacer.

According to a still further aspect of the invention, there is provided electrostatic information recording medium in which an electrode layer and an insulating layer are successively laminated on a substrate to form an electrostatic image on the insulating layer, characterized in that an insulating, patterned layer is provided on said insulating layer as a spacer, or a spacer is defined by a part of said insulating layer on which said electrostatic image is formed, or said substrate is provided therein with a dent in which said electrode and insulating layers are laminated on the bottom thereof with a total thickness smaller than the depth of said dent to use a region of said substrate except said dent as a spacer, or said electrode and insulating layers are successively laminated on said substrate and a spacer is provided on said insulating layer as an insulating, patterned layer.

According to a still further aspect of the invention, there is provided a process for preparing electrostatic information recording medium with an integrally built-in spacer, characterized in that said spacer is formed with an insulating ink by screen printing or an adhesive applied in a patterned form on a region of an insulating layer on which no electrostatic image is to be formed and an insulating film is laminated on the resulting adhesive layer, and an unbonded region of said film is punched cut to form said spacer.

According to a still further aspect of the invention, there is provided a system in which a photosensitive member having an electrode layer and a photoconductive layer laminated successively on a substrate is located in opposite relation to electrostatic information recording medium having an electrode layer and an insulating layer laminated successively on a substrate through a spacer and image exposure is carried out with the application of voltage between both the electrode layers, characterized in that said electrode layer of at least one of said photosensitive member and said electrostatic information recording medium is provided in a patterned form and said spacer is located on an electrode free region thereof.

BRIEF DESCRIPTION OF THE DRAWINGS

FIG. 15 is a diagrammatical sketch showing a still further embodiment of this invention, making use of electrical charging by releasing, FIG. 16(*a*) to 16(*c*) is a diagrammatical sketch for illustrating the separation of electrostatic information recording medium from the photosensitive member after image-recording.

DESCRIPTION OF THE PREFERRED EMBODIMENTS

Figure 2:
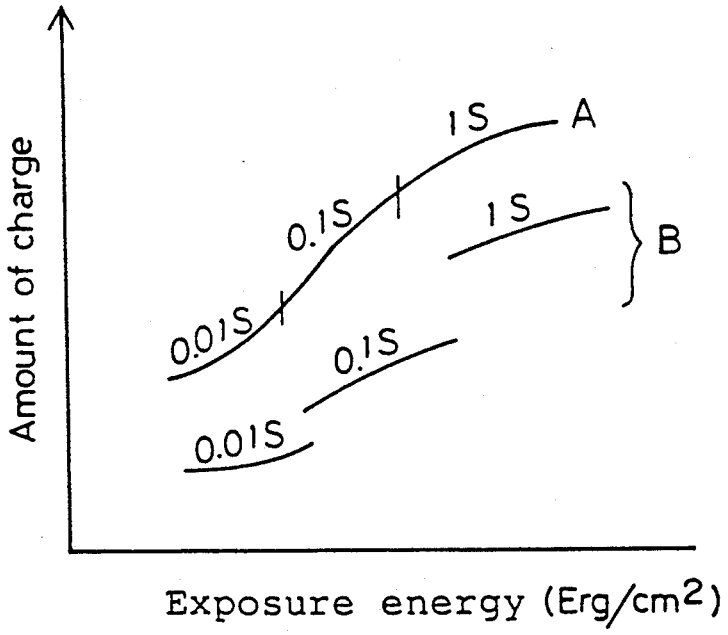
FIG. 2 PRIOR ART
FIG. 2 is a graphical view for illustrating the relationship between the exposure energy and the amount of charges in a conventional exposure process with the application of voltage.
Figure 3:
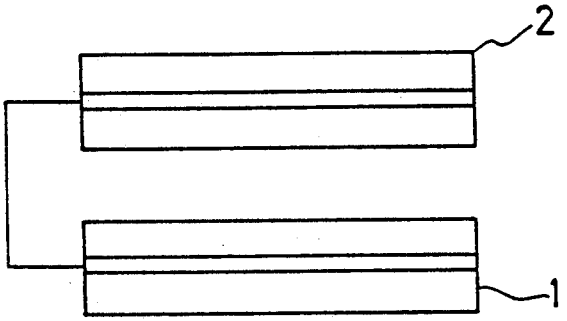
FIG. 3 PRIOR ART
FIG. 3 is a diagrammatical sketch for illustrating how to put off voltage after the image exposure.
Figure 4:
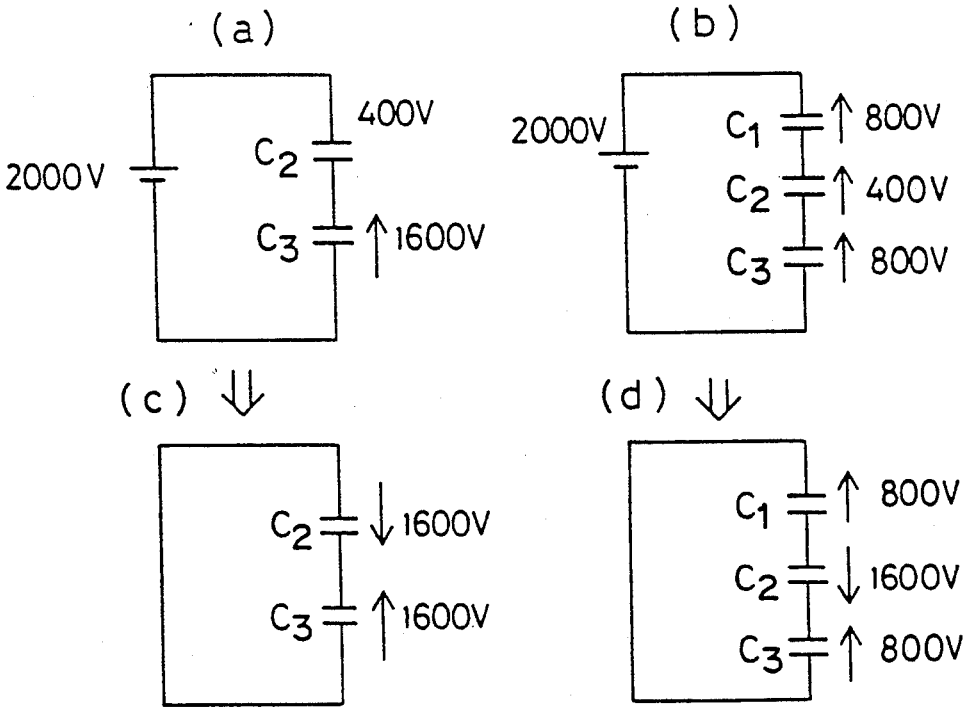
FIG. 4 PRIOR ART
FIG. 4 is an equivalent circuit diagram, FIG 5(*a*) and 5(*b*) is a graphical view for illustrating a mechanism of how inverse discharge is generated.

As already explained with reference to FIG. 2, the photoconductive layer formed of an organic photosensitive member generates carriers upon exposed to light with the application of voltage, but they are so low in terms of mobility that when the voltage is put off, they disappear before reaching the electrostatic information recording medium.

Figure 7:
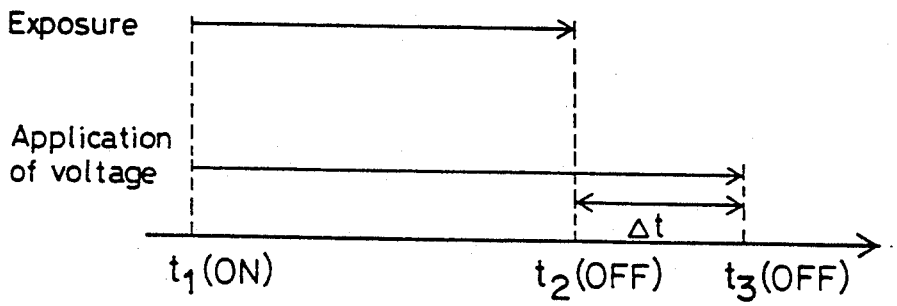
FIG. 7 is a diagrammatical sketch for illustrating the exposure process with the application of voltage according to this invention, in which voltage is applied for a given time after the image exposure.

For the purpose of illustration, now assume that exposure and voltage shutters are put on at a time $t_1$ and the exposure shutter is put off at a time $t_2$. According to this invention, the voltage shutter is then put off at such a preset time $t_3$ so as give a time span $\Delta t$ enough long to allow all the generated carriers to reach the electrostatic information recording medium, as illustrated in FIG. 7. This enables an image to be formed in the amount of charges corresponding to the exposure energy. Since the time span $\Delta t$ from $t_2$ at which the exposure shutter is put off to $t_3$ at which the voltage shutter is put off varies depending upon the type, thickness and other factors of the photosensitive member, it is desirous to tabulate time spans $\Delta t$ found under varied conditions in advance. If the conditions involved are determined, then the desired time span $\Delta t$ may be found from the table to set a timing of when the voltage shutter Is to be put off.

Figure 1:
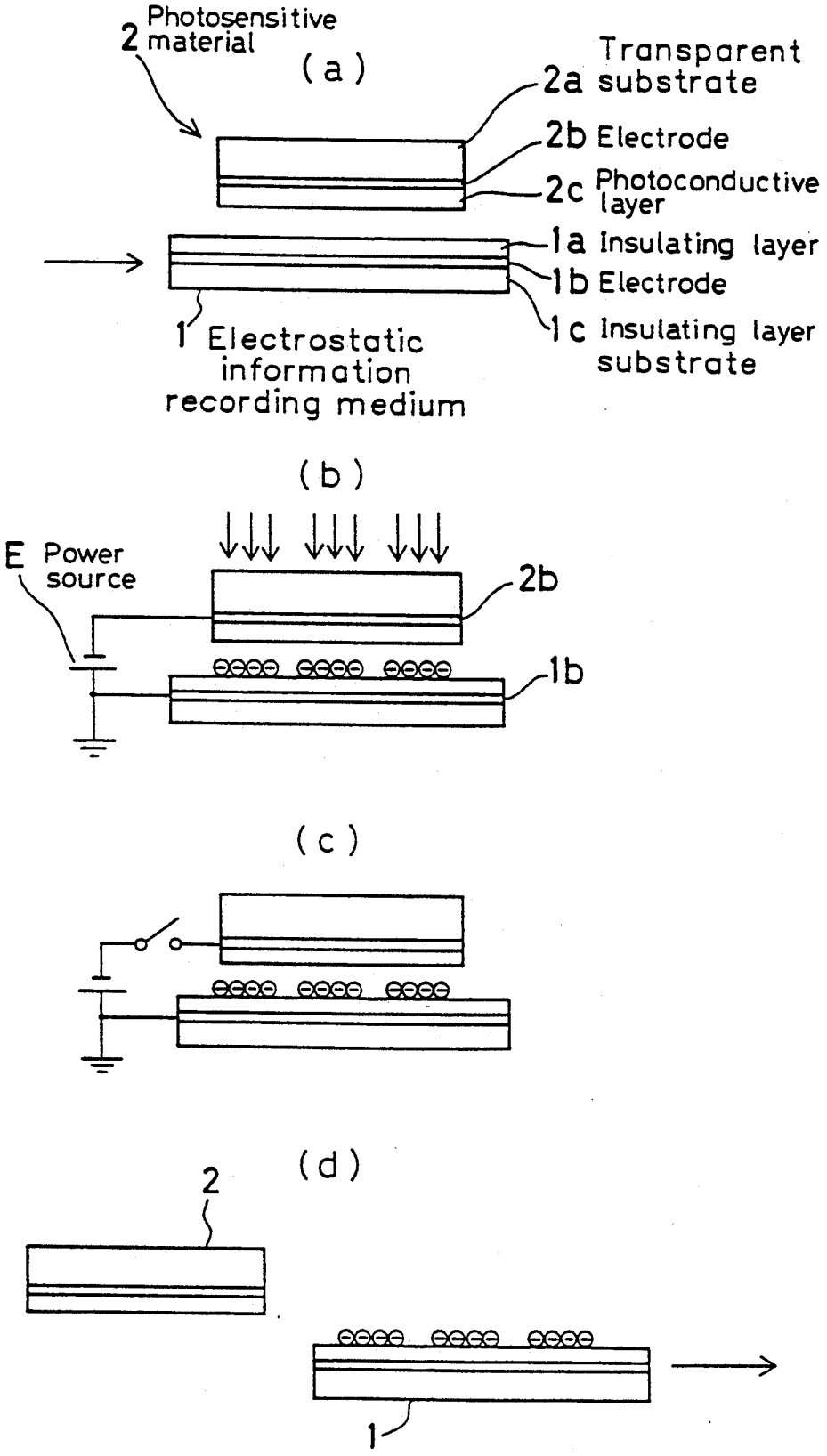
FIG. 1 PRIOR ART
FIG. 1 is a diagrammatical sketch for illustrating how to record electrostatic images.
Figure 8:
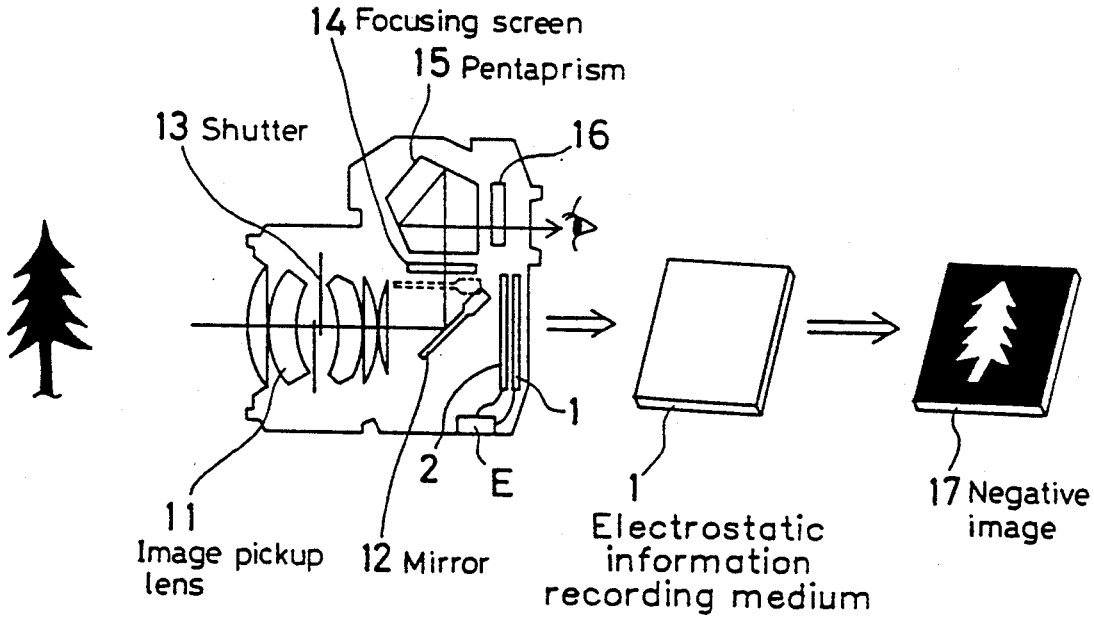
FIG. 8 is a diagrammatical sketch for illustrating an example of the electrostatic camera making use of the exposure with the application of voltage according to this invention, FIG. 9(*a*) to 9(*f*) is a graphical view showing the potential recorded vs. the exposure energy when the optical shutter is synchronized with the voltage shutter or when the voltage shutter is put on at varied times after exposure.

FIG. 8 is a diagrammatical sketch showing an example of the electrostatic camera making use of the exposure with the application of voltage, wherein the same parts as in FIG. 1 are indicated by the same reference numerals, and other reference numerals represent the following elements: 11—an image pickup lens, 12—a mirror, 13—a shutter, 14—a focusing screen, 15—a pentaprism, 16—an eyepiece, 17—a negative image and E—a power source.

For this electrostatic camera, the photosensitive member 2 and electrostatic information recording medium 1, shown in FIG. 1, are used in place of a single-lens reflex camera's film. With a switch (not shown) operated to put on the power source E, voltage is applied to the photosensitive member and electrostatic information recording medium and the shutter 13 is released by a preset time to swing the mirror 12 up to the position shown by a dotted line, forming the electrostatic latent image of a subject on electrostatic information recording medium 1. After a given time has elapsed from the closing of the shutter, the voltage applied between the photosensitive member and the electrostatic information recording medium is put off. If required, the electrostatic information recording medium may then be toner-developed to obtain a negative image 17. It may also be possible to produce electrical signals by reading the electrostatic potential for CRT display or transfer to other recording means such as a magnetic tape.

EXAMPLE 1

For the photosensitive member and electrostatic information recording medium, they were made of an organic photosensitive film of 10 μm in thickness and a fluoropolymer film of 3 μm in thickness, respectively, which were located in opposite relation to each other through a gap of 10 μm, while the photosensitive member was kept positively, a voltage of 750V was applied between the electrodes thereof. The light source was used a tungsten lamp having a color temperature of 3000° K.

Figure 9A:
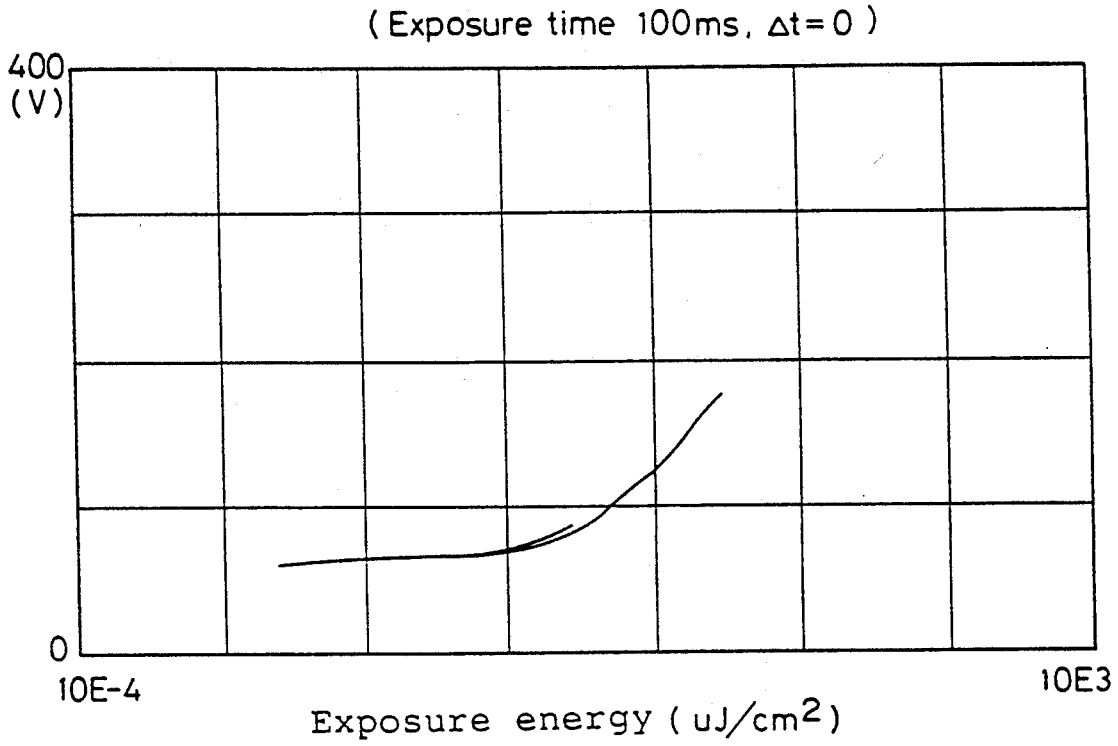

FIG. 9*a*, with the quantity of light exposed to the photosensitive member a abscissa and the potential recorded on the electrostatic information recording medium as ordinate, is a characteristic diagram obtained when a 0.1-second exposure was carried out with the application of voltage, while the voltage shutter was synchronized with the optical shutter, and the voltage was put off simultaneously with putting exposure off ($\Delta t=0$).

Figure 9B:
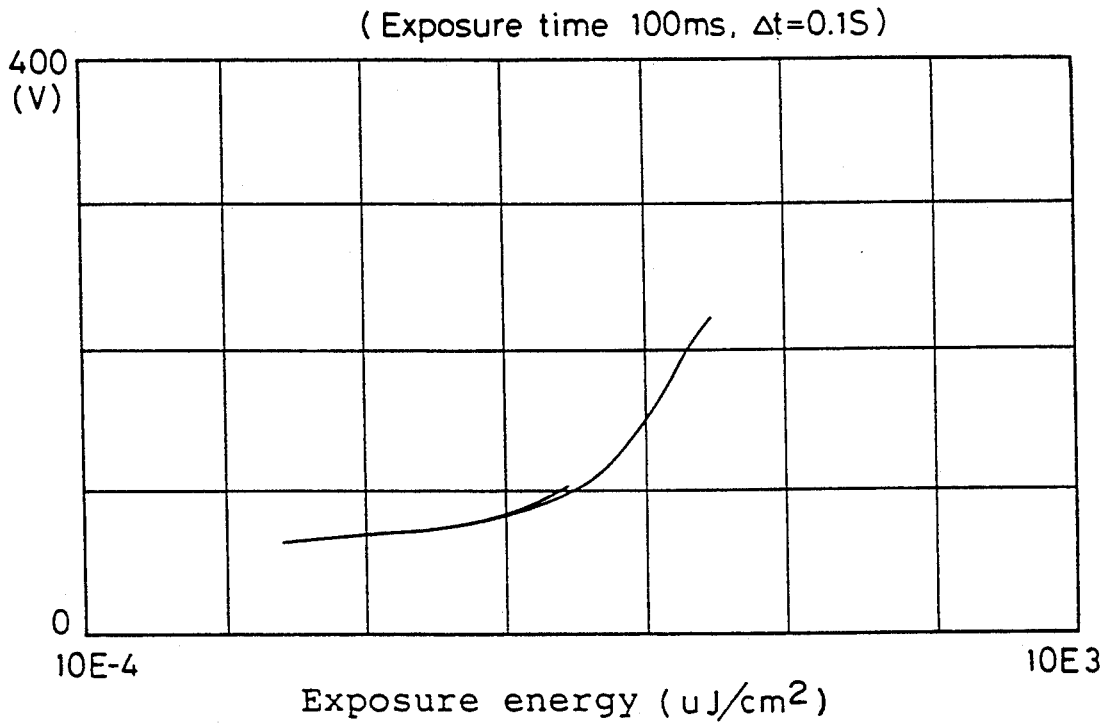

FIG. 9*b* shows the results to an experiment in which after the same sample as used in FIG. 9*a* had been exposed to light at the same exposure intensity for 0.1 second, the application of voltage was continued for a further 0.1 second ($\Delta t=0.1$ second).

A comparison of FIG. 9*a* with FIG. 9*h* indicates that in spite of the photosensitive member being exposed to the same light energy, the potential recorded on the electrostatic information recording medium is much larger in FIG. 9*b* than in FIG. 9*a* in which the voltage pulse is synchronized with the optical shutter; this reveals that FIG. 9*a* in which the application of voltage is continued even after the closing of the optical shutter is much more effective than FIG. 9*b*.

EXAMPLE 2

Figure 9C:
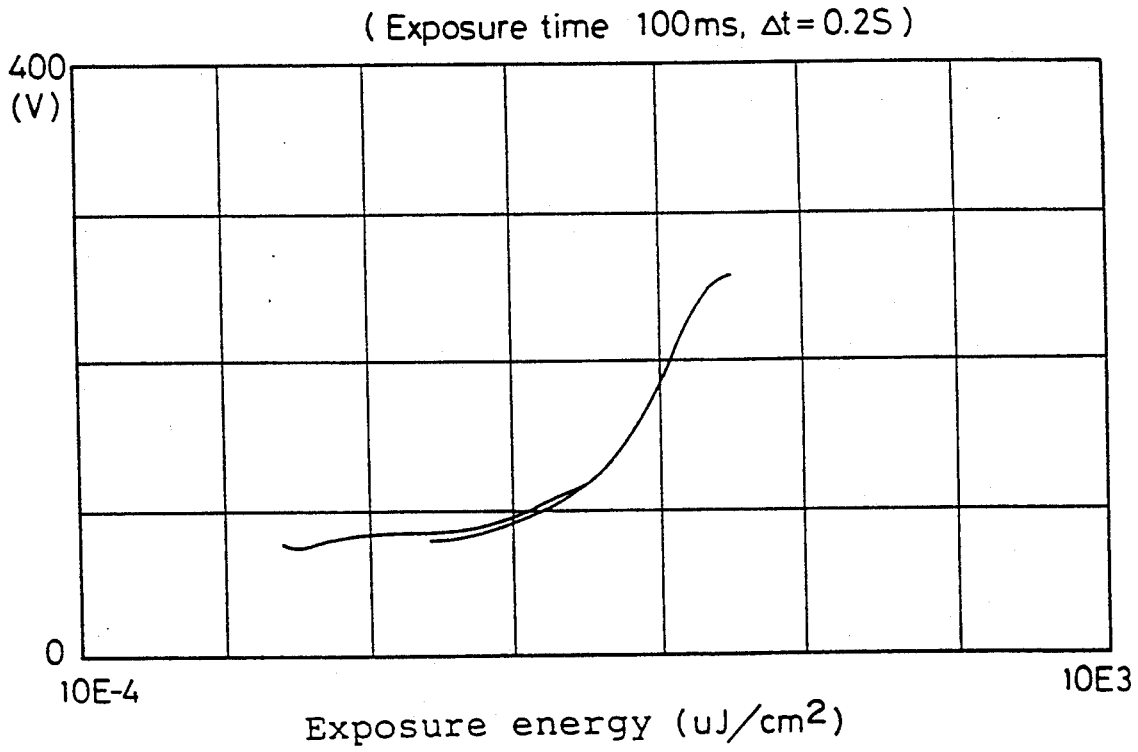

Under similar conditions as mentioned in Ex. 1, the application of voltage was continued for a further 0.2 seconds ($\Delta t=0.2$ seconds) following exposure. The results, as illustrated in FIG. 9*c*, were much more improved than those shown in FIG. 9*a* in which the optical shutter was synchronized with the voltage shutter.

EXAMPLE 3

Figure 9D:
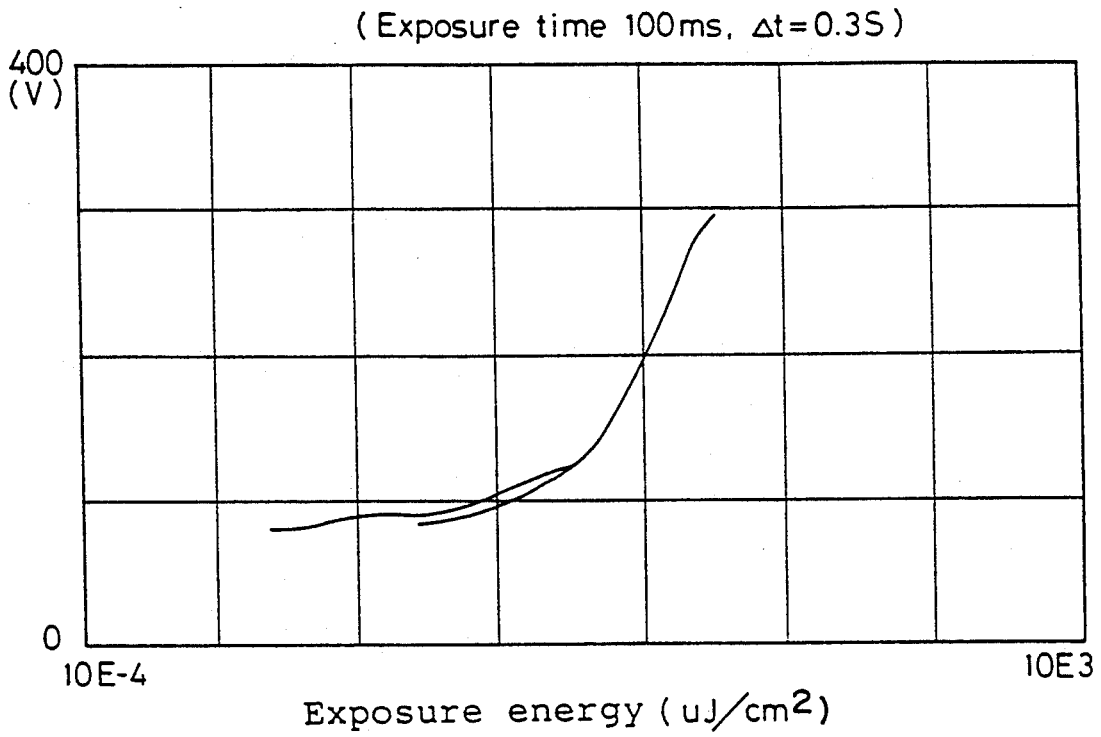
Figure 9:
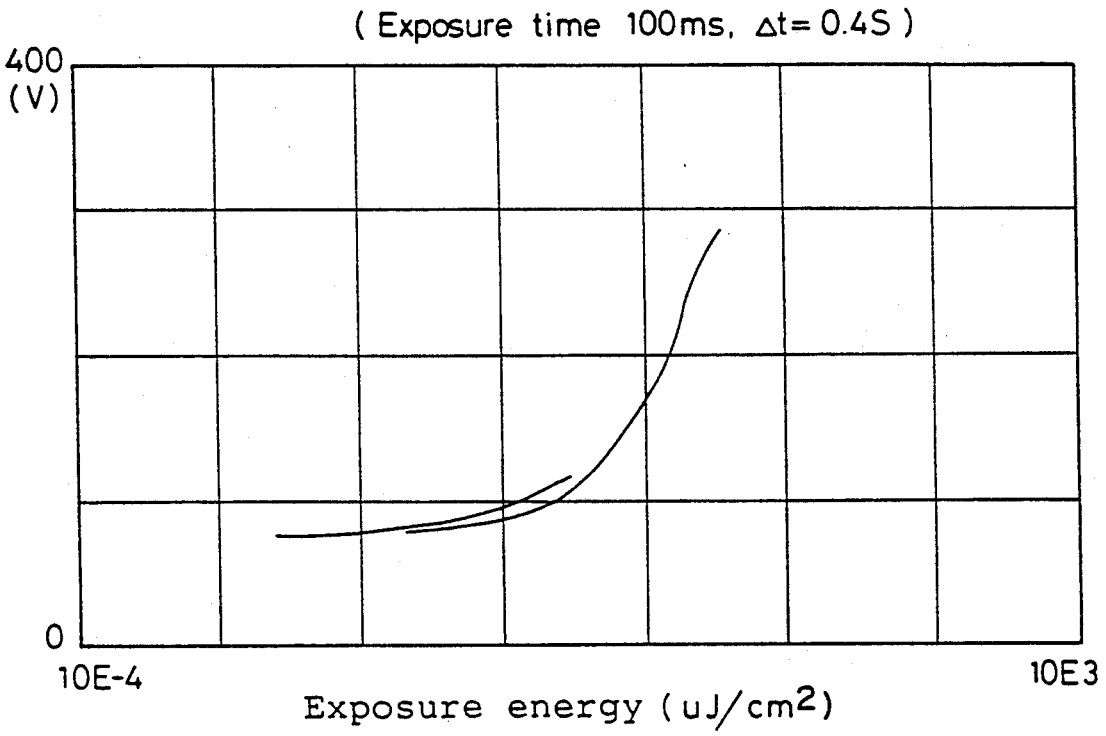
Figure 9:
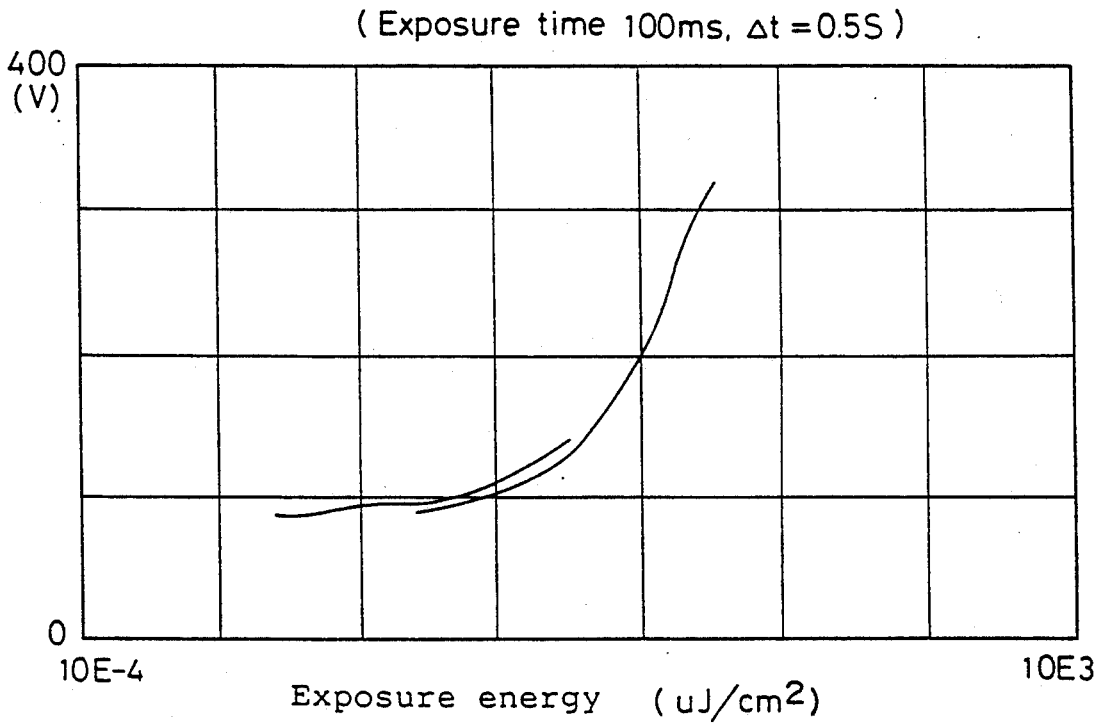

Under similar conditions as mentioned in Ex. 1, the application of voltage was continued for a further 0.3 seconds ($\Delta t=0.3$ seconds) following exposure. The results, as illustrated in FIG. 9*d*, were much more improved than those shown in FIG. 9*a* in which the optical shutter was synchronized with the voltage shutter.

EXAMPLE 4

Under similar conditions as mentioned in Ex. 1, the application of voltage was continued for a further 0.4 seconds ($\Delta t=0.4$ seconds) following exposure. The results, as illustrated in FIG. 9*e*, were much more improved than those shown in FIG. 9*a* in which the optical shutter was synchronized with the voltage shutter.

EXAMPLE 5

Under similar conditions as mentioned in Ex. 1, the application of voltage was continued for a further 0.5 seconds ($\Delta t=0.5$ seconds) following exposure. The results, as illustrated in FIG. 9*f*, were much more improved than those shown in FIG. 9*a* in which the optical shutter was synchronized with the voltage shutter.

Thus, it is possible to accumulate all the generated carriers on the electrostatic information recording medium as charges in the amount corresponding to the quantity of exposure irrespective of the voltage shutter time.

Figure 10:
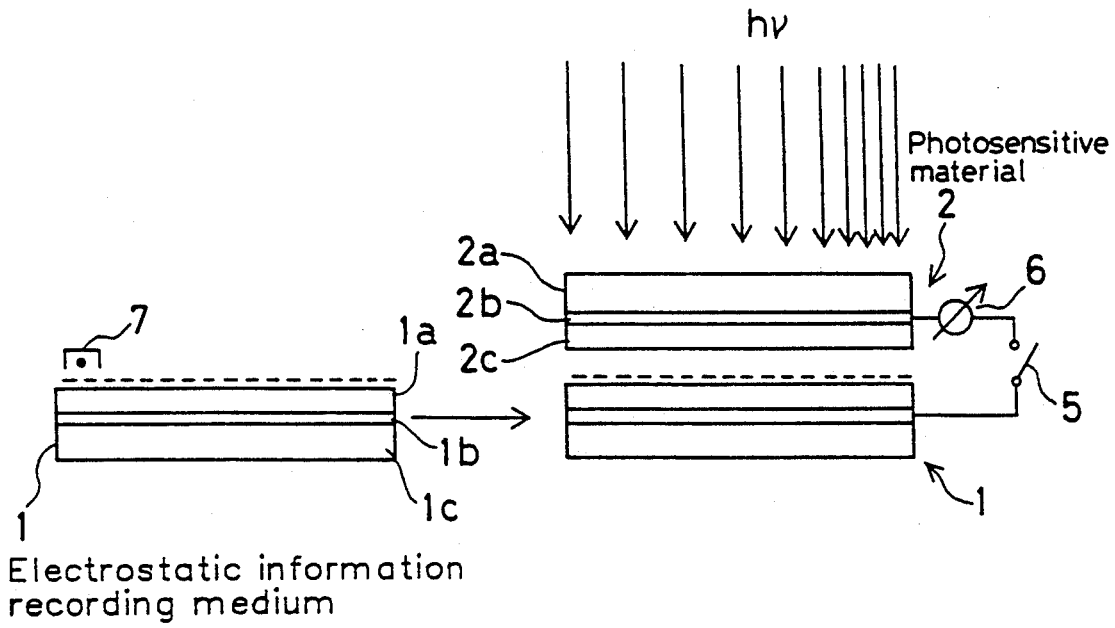
FIG. 10 is a diagrammatical sketch for illustrating the process for forming images according to this invention.

FIG. 10 is a diagrammatical sketch provided to illustrate how to form an image on an electrostatic information recording medium pre-charged with electricity, wherein reference numeral 5 represents a switch, 6 an ammeter and 7 a corona charger.

Referring to FIG. 10, electrostatic information recording medium 1 is formed by providing a 1000-Å thickness A1 electrode 1*b* on an insulating layer support 1*c* made of a 1-mm thick glass by vapor deposition and providing a 10-μm thickness insulating layer 1*a* on this electrode 1*b*, and photosensitive member 2 is constructed by forming a 1000-Å thickness, transparent electrode 2*b* of ITO on a photoconductive layer support 2*a* made of a 1 μm thickness glass and providing a photoconductive layer 2*c* of about 10 μm in thickness on this electrode 2*b*. The electrostatic information recording medium 1 is located with respect to the photosensitive member 2 through a gap of about 10 μm.

Figure 11:
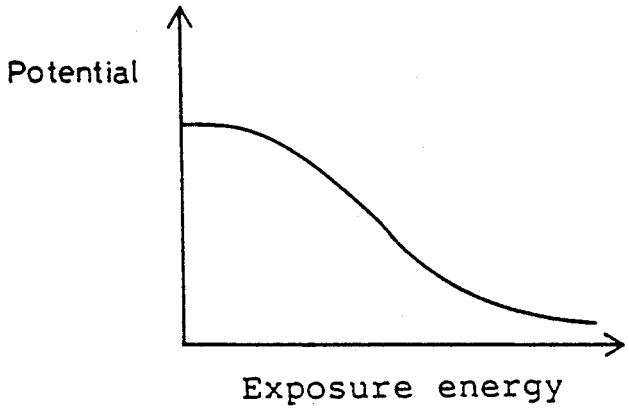
FIG. 11 is a graphical view showing the relationship between the exposure energy and the surface potential of the electrostatic information recording medium.

The electrostatic information recording medium 1 is at first discharged by the previous application of voltage to, e.g. corona charge, thereby charging the insulating layer 1*a* to a given potential. In this case, it is desired that the electrostatic information recording medium has been charged to a given level in advance, because the charging device needs a high-voltage power source. This electrical charging, of course, may be achieved by the exposure with the application of voltage. In this case, the power source may be built in the system without any external power source of a large size, since air discharge is achieved by the application of a voltage as low as a few hundreds V to 1 KV. Alternatively, use may made of electrical charging as by friction or releasing. In this case, electrostatic information recording medium 1 may be electrified with charges opposite in polarity to the majority carriers generated in the photosensitive member (charges that are easily transportable by virtue of their own polarity). The majority carriers are positive charges in the organic photosensitive member, but take the form of either negative or positive charges in the inorganic photosensitive member depending upon of what material it is formed. When using the organic photosensitive member, therefore, it is required to electrify electrostatic information recording medium with negative charges. Then, while the thus electrified electrostatic information recording medium 1 is set with respect the photosensitive member 2 through a gap of about 10 μm, the switch 5 is closed to short-circuit the electrodes 1*b* and 2*b*. Although charges opposite in polarity to the negative charges on the surface of the insulating layer, i.e., positive charges have been induced on the electrode 1*b*, they are partly distributed to the electrode 2*b* by short-circuiting the electrodes 1*b* and 2*b*, producing a given voltage difference between electrostatic information recording medium and the photosensitive member. When the image exposure is carried out through, e.g., the photosensitive member in this state, the photoconductive layer 2*c* generates carriers or positive charges, which are in turn transported toward the surface of electrostatic information recording medium while attracted thereby. Then, they are bonded on the surface of the photoconductive layer to the negative charges ionized in the gap for neutralization, while the positive charges ionized in the gap are attracted toward electrostatic information recording medium and neutralized with the negative charges on the surface of the insulating layer. The amount of the positive charges neutralized with the negative charges on the surface of the insulating layer corresponds to the exposure energy; such a surface potential as shown in FIG. 11 is obtained on the insulating layer corresponding to the exposure energy. Thus, the electrostatic latent image is defined by the surface potential of the insulating layer corresponding to the exposure energy. In this case, regions exposed to large quantities of light drop in potential. For instance, the image becomes whitish, when developed with toner. Thus, this image-recording process, which gives a positive image, is very advantageous for forming a frosted image using, for instance, a thermoplastic resin as the electrostatic information recording medium. It is noted that when the switch is put off, the majority carriers are not transported from the photosensitive member even though it is exposed to light, so that no latent image can be formed; the on-off control of the switch can have the same function as a shutter. It is also noted that the total amount of charges transported from the photosensitive member can be found by monitoring the ammeter 6; this ammeter may be used as an exposure meter, for instance, when used with an electrostatic camera. In addition, it is possible to achieve noise-free images of high quality, since no energy but light is injected for the image exposure.

It is understood that the photosensitive member 2 and electrostatic information recording medium 1 may be arranged not only in noncontact relation, as mentioned above, but also in contact relation, to each other. When they are placed in contact relation to each other, the charges generated from the exposed region, while attracted toward the electrostatic information recording medium, pass through the photoconductive layer and the electrically conductive layer 2*c* and reach the surface of the insulating layer 1*a*, where they are neutralized with the charges thereon, forming an electrostatic latent image. Then, the switch 5 is put open to separate the electrostatic information recording medium 1 from the photosensitive member 2.

It is understood that while electrostatic information recording medium has been described as previously charged with electricity, images may be formed in similar manner as mentioned above, even with the photosensitive member previously charged with electricity.

When this recording process is used for planar analog recording, the resulting resolving power is as high as achieved with conventional photography. Also, the surface charges formed on the insulating layer 1*a* is exposed to atmospheric environment, but they are stored over an extended period with no discharge, whether placed in a bright or dark place, since air behaves an a good insulator.

Figure 12:
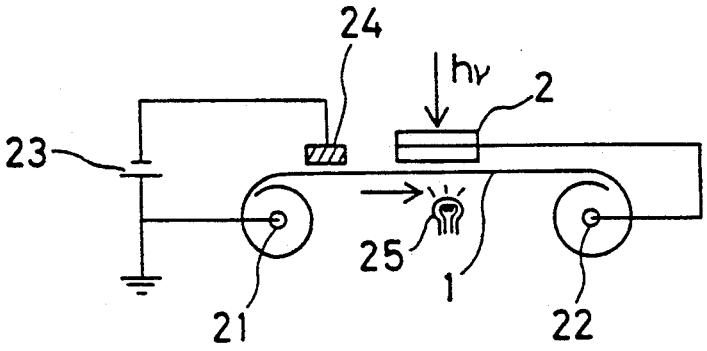
FIG. 12 is a diagrammatical sketch showing one embodiment of this invention, making use of electrical charging by the application of voltage.

FIG. 12 is a diagrammatical sketch for illustrating an example of an electrostatic camera system to which the image-recording process of FIG. 11 is applied.

In this example, electrostatic information recording medium 1 in the form of a film is successively fed from a feed reel 21 to a take-up reel 22 in opposite relation to a photosensitive member 2. Then, the image exposure is carried out through the photosensitive member, while the take-up reel and the photosensitive member's electrode are short-circuited.

On the upstream side of the photosensitive member 2, an electrode 24 is located in opposite relation to the film-form electrostatic information recording medium 1. Then, voltage is applied from a power source 23 between the electrode 24 and the electrostatic information recording medium 1 for electrical charging, and the image exposure is carried out through the photosensitive member, thereby forming electrostatic latent images successively. In this case, a persistence of the opposite polarity may remain on the photosensitive member 2 after the first shot image pickup. Preferably, that persistence should be removed by exposing the photosensitive member 2 intermittently and uniformly to light having a wavelength to which it shows sensitivity and emanating from a certain light source 25 (e.g. a halogen lamp) prior to the next or second shot image pickup. In that case, the electrode or support of the charge-carrying film 1 must be transparent as such, or transparent to erasure light.

Figure 13:
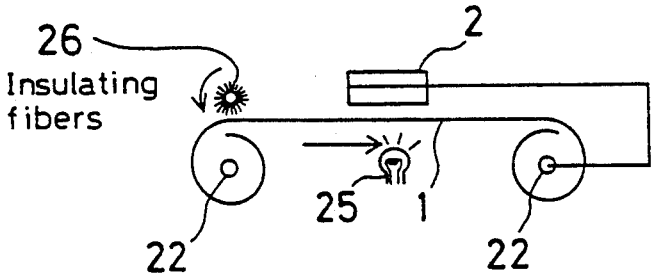
FIG. 13 is a diagrammatical sketch showing another embodiment of this invention, making use of electrical charging by friction.

FIG. 13 is a diagrammatical sketch showing another embodiment of this invention making use of electrical charging by friction.

This embodiment is similar to the embodiment of FIG. 12 with the exception that a roll 26 constructed from insulating fibers is disposed on the upstream side of a photosensitive member 2 such that while turned, it comes into rubbing friction with a film-form electrostatic information recording medium for uniform electrical charging and, because of needing no power source for electrical charging, lends itself well fit for constructing a portable type of electrostatic camera.

Figure 14:
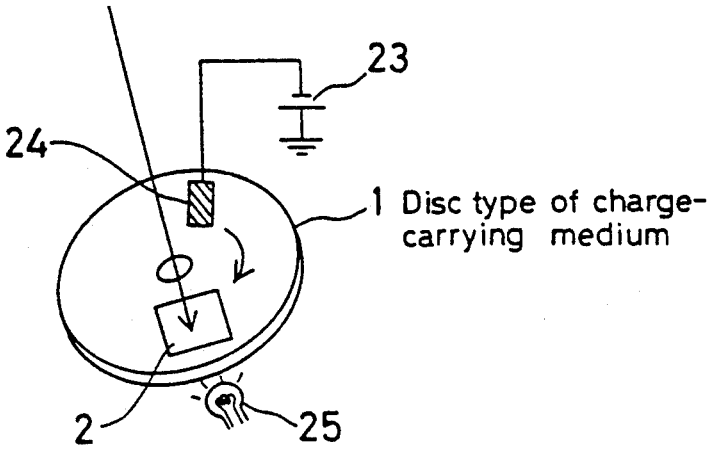
FIG. 14 is a diagrammatical sketch showing a further embodiment of this invention, wherein electrostatic information recording medium is in the form of a disk.

FIG. 14 shows a further embodiment of this invention making use of a disc type of electrostatic information recording medium.

According to this invention, a disc type of electrostatic information recording medium 1 is designed to be so turnable that voltage can be applied to its electrode 24 thereof to electrify its surface uniformly. Then, while a photosensitive member 2 is located on the downstream side of the electrode 24 in opposite relation to a part of the surface of electrostatic information recording medium 1, both the members are electrically short-circuited. Thus, it is possible to form a similar electrostatic latent image by carrying out the image exposure through the photosensitive member 2.

FIG. 15 shows a still further embodiment of this invention making use of "electrical charging by releasing".

According to this embodiment, electrostatic information recording medium 1 includes an electrode 1*b* and support films 1*e* and 1*c* between which an insulating release layer 1*d* is laminated on a charge-carrier layer 1*a*, as shown in FIG. 15*a*. The thus constructed film type of electrostatic information recording medium 1 is fed from a film supply case 30 between a pair of rolls 33 and 34 to separate the relase layer 1*d* from the electrostatic information recording medium. Then, the release layer is rolled around a take-up reel 35, while the charge-carrying film is rolled around a take-up case 31. This releasing enables the charge-carrying layer of the charge-carrying film to be charged on its surface with electricity. Afterwards, while the charge-carrying film is located in opposite relation to a photosensitive member 2, the image exposure is carried out through the photosensitive member 2, thereby making it possible to from an electrostatic latent image on the charge-carrying film. This embodiment, because of needing no power source for electrical charging, lends itself well fit for constructing an electrostatic camera.

It is thus possible to obtain a positive image by using the previously electrified electrostatic information recording medium, locating it in opposite relation to the photosensitive member and placing the electrical connection between their respective electrodes under on-off control instead of using any type of shutter, thereby controlling the formation of the image. Also, no energy but the "image light" is injected for exposure; noise-free images of high quality is achievable.

Figure 16:
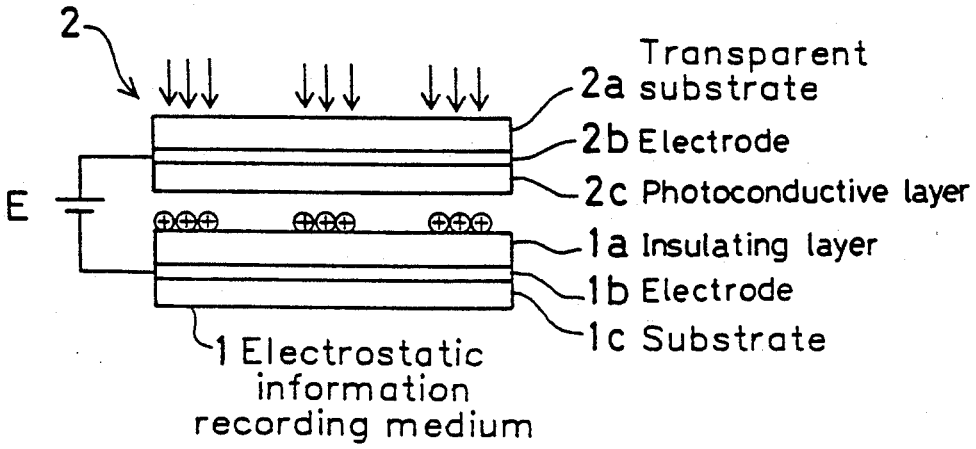
Figure 16:
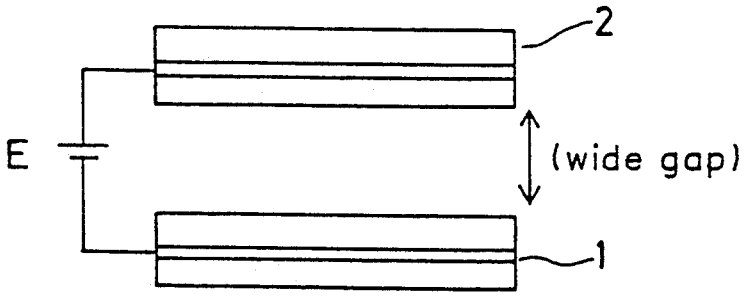
Figure 16:
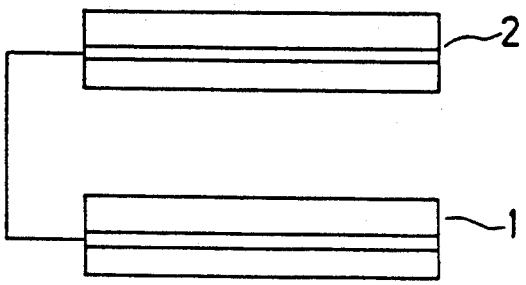
Figure 17:
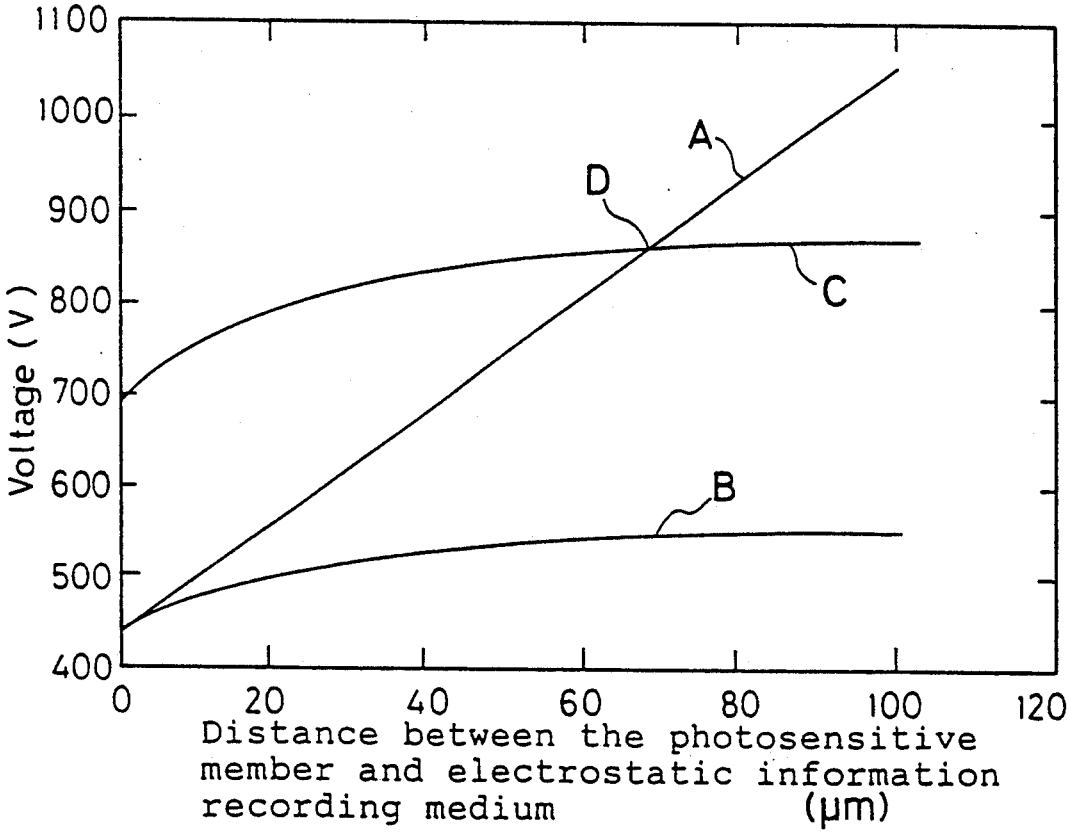
FIG. 17 is a graphical view showing the relationship between the discharge breakdown voltage and the voltage applied to a gap.

FIG. 16 illustrates how to prevent inverse discharge from occurring after image-recording, and FIG. 17 shows the relationship between the discharge breakdown voltage and the voltage applied to a gap.

As illustrated in FIG. 16*a*, an electrostatic charge image is formed on electrostatic information recording medium 1 by carrying out exposure with voltage applied between a photosensitive member and the electrostatic information recording medium. Then, either electrostatic information recording medium or the photosensitive member is moved to space them away from each other to define a space wider than predetermined, as shown in FIG. 16 *b*.

For instance, now consider a system comprising an organic photosensitive member formed of polyvinylcarbazole (having a specific inductivity of 3 and a thickness of 10 μm) and a charge-carrying medium formed of a silicone resin or fluoropolymer (having a specific conductivity of 3 and a thickness of 10 μm)—which are located in opposite relation to each other through a gap of 20 μm with the application of a voltage of 1500V. As illustrated in FIG. 17 with the distance between the electrostatic information recording medium and the photosensitive member as abcissa and the potentials found at various positions as ordinate, the intra-gap discharge breakdown voltage found from the Paschen's law is represented by a curve A, the voltage applied to the gap in the presence of voltage by a curve B and the voltage applied to the gap at 0 volt by a curve C.

Accordingly, the voltage is reduced to zero after spacing the photosensitive member away from the electrostatic information recording medium by a distance longer than that defined by a point D at which the curves A and C intersect. Thereupon, no discharge will occur because the discharge breakdown voltage is higher than the voltage applied to the gap. For this reason, the photosensitive member is separated from the electrostatic information recording medium until such a state is reached, after which if they are short-circuited, as shown in FIG. 16*c*, the electrostatic information recording medium can then be removed with no fear of discharge.

When the voltage applied was reduced to zero without separating the photosensitive member from the electrostatic information recording medium while the same conditions as illustrated in connection with FIG. 17 were applied as the thickness and voltage impressed, the potentials of the exposed and unexposed sites were found to be 822V and 290V. respectively. However, when the voltage applied was reduced to zero after they had been spaced away from each other so as to prevent inverse discharge from occurring—with the voltage remaining impressed to the gap, the potentials of the exposed and unexposed sites were found to be 991V and 459V, respectively; high signal voltage could be obtained.

It is noted that while the gap has been described as filled with air, it may be filled with, e.g. a transparent gas having an increased dielectric constant to boost the discharge breakdown voltage, thereby making inverse discharge unlikely to occur.

It is also noted that the photosensitive member and the electrostatic information recording medium should, preferably but not exclusively, be spaced away form each other in parallel relation. In other words, they may be spaced away from each other transversely or at a certain angle, or may be fixed together at one ends and peeled away from each other at the free ends.

It is thus possible to obtain high signal voltage without either inducing inverse discharge or making the resulting image dim by forming an electrostatic latent image by the exposure with the application of voltage, then spacing the photosensitive member from the electrostatic information recording medium with the voltage remaining impressed, and finally putting off voltage supply in a state where the discharge breakdown voltage exceeds the voltage applied to the gap.

Figure 18:
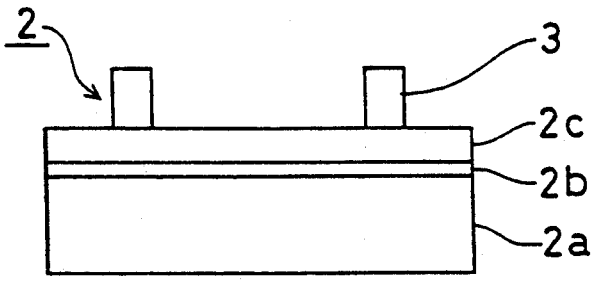
FIG. 18 is a diagrammatical sketch showing an example of one photosensitive member in which the spacer is integrally provided on the photoconductive layer.

FIG. 18 is a diagrammatical sketch showing an example of one photosensitive member in which an insulating, patterned layer is integrally provided on a photoconductive layer as a spacer.

As illustrated, the photosensitive member includes an electrode layer 2*b* and a photoconductive layer 2*a* laminated on a substrate 2*c* in the order and a patterned space 3 printed or otherwise formed on the photoconductive layer 2*a*.

Thus, if the photoconductive layer includes the spacer 3 previously printed or otherwise formed thereon, it is then possible to keep its thickness constant with high accuracy; a constant gap can be obtained by mere superposition of the photosensitive member on the associated electrostatic information medium. In addition, the occurrence of discharge breakdown can be avoided because of no likelihood that dust, etc. may enter between the spacer and the photoconductive layer.

Figure 19:
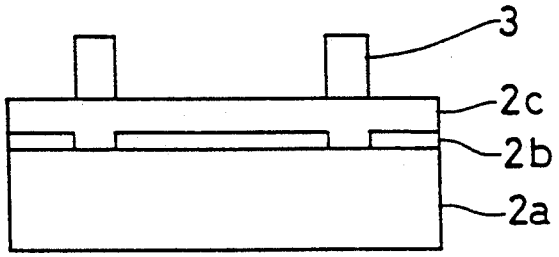
FIG. 19 is a diagrammatical sketch showing an example of another photosensitive member in which the electrode is provided in a patterned form and the spacer is integrally provided on the region of photoconductive layer in which the electrode is removed.

FIG. 19 illustrates an example of another photosensitive member in which a patterned electrode layer 2*b* is formed on a substrate 2*a* and a spacer 3 is provided on an electrode-free region of the substrate 2*a*. Such an arrangement—wherein no electrode layer is found on the spacer region—assures to prevent voltage from being applied to the spacer region and so discharge breakdown from occurring there.

Figure 20:
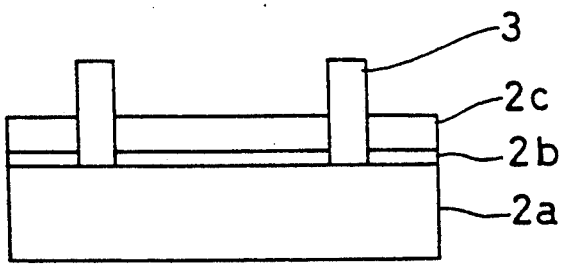
FIG. 20 is a diagrammatical sketch showing an example of a further photosensitive member in which the spacer is integrally provided on an electrode-free region of the substrate.

FIG. 20 shows an example of a further photosensitive member which is similar to that of FIG. 19 in that a patterned electrode layer 2*b* is formed on a substrate 2*a* and a spacer 3 is provided on an electrode-free region of the substrate 2*a* but which is different therefrom in that a photoconductive layer 2*c* is thinner than the spacer 3. As is the case with FIG. 19, it is possible to prevent voltage from being applied to the spacer region and hence discharge breakdown from occurring through the spacer 3.

Figure 21:
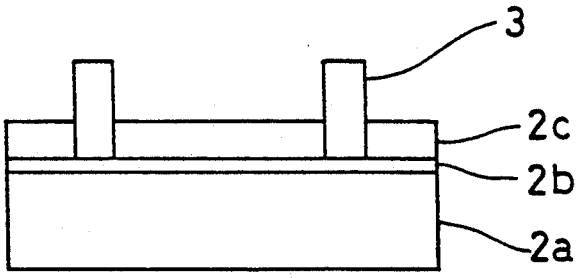
FIG. 21 is a diagrammatical sketch showing an example of a still further photosensitive member in which the spacer is integrally provided on the electrode layer.

FIG. 21 shows an example of a still further photosensitive member in which a previously patterned spacer 3 is provided on an electrode layer 2*b* formed uniformly on a substrate 2*a* and a photoconductive layer 2*c* is laminated on a spacer-free region of the electrode layer 2*b* to a thickness thinner than the spacer 3. In this case, voltage is applied to the spacer, but it is possible to prevent the discharge breakdown of the photoconductive layer from occurring through the space 3, because the spacer region is cleared of the photoconductive layer 3*c*, as mentioned above.

Figure 22:
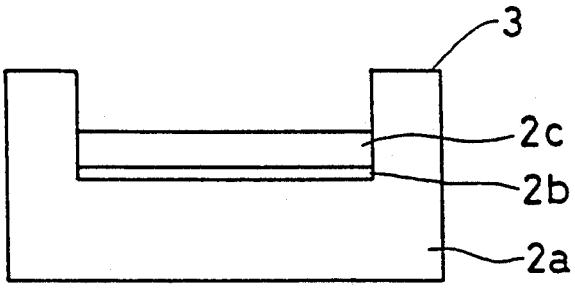
FIG. 22 is a diagrammatical sketch showing an example of still further photosensitive member in which the spacer is defined by a part of the substrate.

FIG. 22 shows an example of a still further photosensitive member in which a substrate 2*c* made as of glass is etched out at its center to make a dent and an electrode layer 2*b* and a photoconductive layer 2*a* are laminated on the bottom of the dent with a total thickness smaller than the depth of the dent, leaving projections on both the sides. In this case, it is also possible to prevent the discharge breakdown of the photoconductive layer which may otherwise occur through the spacer, because the spacer region receives no voltage and is cleared of the photoconductive layer.

Figure 6:
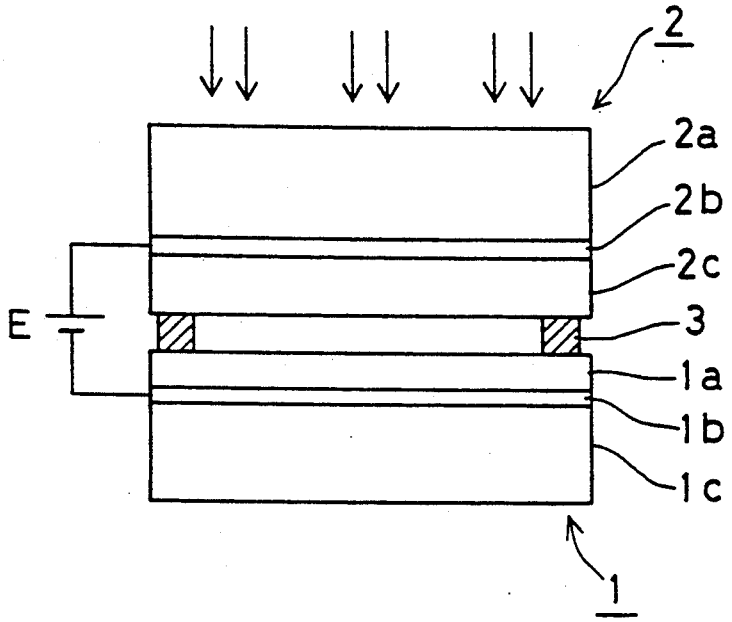
FIG. 6 PRIOR ART
FIG. 6 is a diagrammatical sketch for illustrating a conventional image-recording process making use of a spacer.
Figure 23:
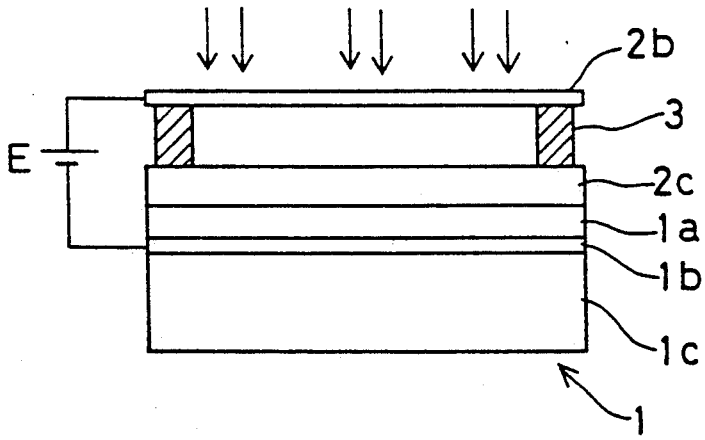
FIG. 23 is a diagrammatical view showing an example of carrying out electrostatic image-recording by providing the photoconductive layer on the insulating layer.

While the process for recording electrostatic images shown in FIG. 6 has been described with reference to the system in which the photosensitive member is located in opposite relation to electrostatic information recording medium through the spacer, it is understood that a transparent electrode 2*b* may be located in opposite relation to electrostatic information recording medium 1 through a photoconductive layer laminated on an insulating layer 1*a* thereof and a spacer 3 to carrying out the image exposure with voltage applied between an electrode layer 1*b* of the medium 1 and the transparent electrode 2*b*, thereby forming an electrostatic image on the interface of the insulating layer 1*a* and the photoconductive layer 2*c*, as shown in FIG. 23. Even in the case of such a recording process, it is possible to prevent discharge breakdown due to dust or other deposits by providing the spacer on the photoconductive layer 2c as an integral piece.

Such photosensitive members with integrally built-in spacers will now be explained more illustratively with reference to Examples 6–11.

EXAMPLE 6

A glass sheet ("Glass 7059" made by Corning Co., Ltd., 45×50, 1.1t) was coated thereon with a negative type of photoresist. After this substrate had been masked at its central region of 35×45, it was exposed to light and developed to expose only the glass of the central region to view. After that, the glass was etched out to a depth of 10 μm with hydrofluoric acid.

Then, the resist was removed to prepare a substrate, which was in turn provided thereon with a transparent electrode layer and a photosensitive layer, each in a film form, thereby obtaining a photosensitive member.

EXAMPLE 7

The procedures of Example 6 were followed with the exception that the negative resist was used as such to provide thereon with a transparent electrode in a film form and the resist was then removed with the transparent electrode thereon, followed by forming a photosensitive layer in a film form.

EXAMPLE 8

According to the procedures of Ex. 6, etching was performed to a depth of 30 μm, followed by forming a transparent electrode layer and a 20-μm thickness photosensitive layer, each in a film form. After the product was coated on the surface with a photoresist, it was exposed to light and developed using the same mask pattern as used in Ex. 6, thereby etching the photosensitive and transparent electrode layers to the surrounding glass surface.

EXAMPLE 9

A glass sheet provided on the surface with a transparent electrode layer was screen-printed with an insulating paste after a certain pattern. Then, the patterned paste was dried and calcined to a height of 30 μm. After that, a photosensitive layer was formed on a region of the glass sheet except the insulating pattern layer to prepare a photosensitive member.

EXAMPLE 10

The procedures of Ex. 9 were followed with the exception that a region of the transparent electrode to be screen-printed has been etched out.

In this case, the paste to be screen-printed was not particularly required to possess insulating properties.

EXAMPLE 11

A transparent electrode layer and a photosensitive layer were laminated successively on glass, and an insulating paste was screen printed on the laminate after a certain pattern to prepare a photosensitive member.

With such photosensitive members with integrally built-in spacers, it is possible to dispense with interposing additional spacers between them and the associated electrostatic information recording medium; image-recording is more easily achievable. In addition, there is no fear that dust or other deposits may be accumulated between the spacers and the photoconductive layers, inducing discharge breakdown. It is also possible to prevent discharge breakdown through the spacers by providing the spacers on patterned electrode layer-free regions.

Next, reference will now be made of some embodiments of the electrostatic information recording medium which includes an insulating spacer formed integrally on the insulating layer for accumulating charges thereon and can give a certain discharge gap by mere superposition of it on the associated photosensitive member.

Figure 24:
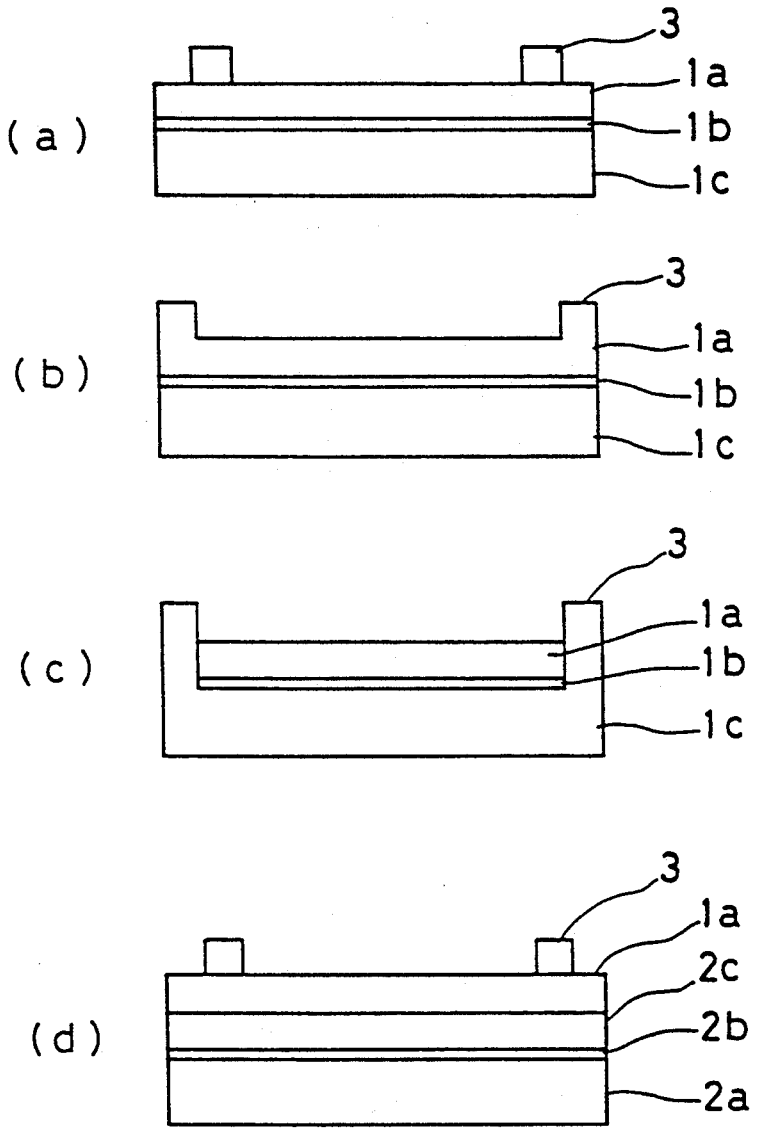
FIG. 24 is a diagrammatical sketch for illustrating an example of one electrostatic information recording medium with an integrally built-in spacer.

For instance, a spacer 3 is integrally printed or otherwise formed on a laminate comprising an electrode layer 1b and an insulating layer 1b laminated successively on a substrate 1c, as illustrated in FIG. 24a. Only with the associated photosensitive member superposed on this electrostatic information recording medium, it is possible to obtain a constant discharge gap; it is possible to achieve easy image pickup and cope with high-speed image pickup. Even when such electrostatic information recording medium—in which images have been stored—are stacked up for storage, it is possible to prevent the insulating layers from coming into contact with the substrates and so prevent the charges from falling in disarray, because one electrostatic information recording medium is placed at the substrate on the spacer of another. When a flexible substrate is used to roll up a photographed electrostatic information recording medium of continuous length, the presence of the spacer 3 makes the insulating layer 1a unlikely to come into contact with the substrate, thus preventing the charges from falling into disarray.

FIG. 24b shows an example of another electrostatic information recording medium in which a spacer 3 is formed of the same material of which an insulating layer 1a is made. For instance, the insulating layer 1a is dented at its central region as by etching to form the spacer 3 therearound.

FIG. 24c shows an example of a further electrostatic information recording medium in which a substrate 1c is dented as by etching and an electrode layer 1b and an insulating layer 1a are laminated on the bottom of the dent with a thickness smaller than the depth of the dent to form a spacer 3 by a region of the substrate projecting from the insulating layer 1a.

Figure 25:
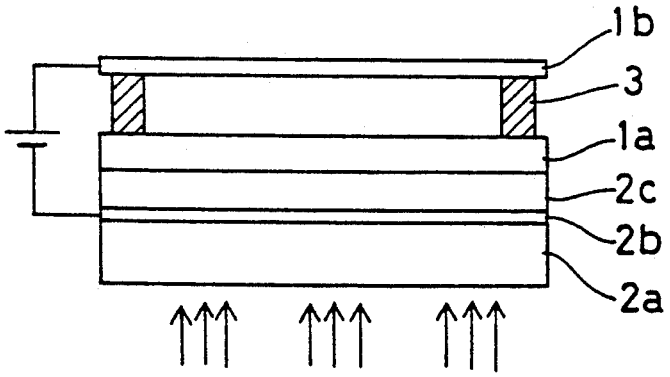
FIG. 25 is a diagrammatical sketch showing an example of carrying out electrostatic image recording by forming an insulating layer on a photoconductive layer.

FIG. 24d shows an example of a photosensitive member comprising a laminate of a substrate 2a, an electrode 2b and a photoconductive layer 2c, in which an insulating layer 1a is laminated on the photoconductive layer 2c and a spacer 3 is integrally formed on the insulating layer 1a. In order to form images with this photosensitive member, an electrode 1b is first located in opposite relation to the insulating layer 1b through the spacer 3, as illustrated in FIG. 25. Then, the image exposure is carried out while voltage is applied between the electrodes 1b and 2b, whereby carriers generated in the photoconductive layer 2c migrate to the interface between it and the insulating layer 1a, so that discharge takes place between the insulating layer 1a and the electrode layer 1b to form an electrostatic image on the insulating layer 1a. In the case of the system shown in FIG. 25, the discharge gap can be easily kept constant by providing an insulating, patterned layer on the insulating layer 1a to form a spacer.

In what follows, such electrostatic information recording medium with integrally built-in spacers will be explained more illustratively with reference to Examples 12–16.

EXAMPLE 12

Two (2) % by weight of a curing catalyst ("CR-12" made by Toshiba Silicone Co., Ltd.) diluted with n-butyl alcohol at a weight ratio of 1:1 were added to a 50% solution of methyl-phenyl silicone varnish in xylene ("TSR-144 made by Toshiba Silicone Co., Ltd ), followed by full stirring and filtration through a mesh. The filtrate was spin-coated on an ITO electrode layer (with a thickness of about 500 Å and a resistance value of 80Ω/sq) provided on a glass substrate first at 4000 rpm for 2 seconds and then at gradually decreased revolutions per minute over a period of 30 seconds. After that, the product was heated in an oven of 150° C. for 1 hour for drying and curing, thereby forming on the ITO electrode a methyl-phenyl silicone varnish layer of 6 μm in thickness. Then, an insulating ink was coated on the varnish layer with a striped screen printing plate and dried to form a spacer having a thickness of 10 μm.

EXAMPLE 13

Two (2) % by weight of a curing catalyst ("CR-12" made by Toshiba Silicone Co., Ltd.) diluted with n-butyl alcohol at a weight ratio of 1:1 were added to a 50% solution of methyl-phenyl silicone varnish in xylene ("TSR-144 made by Toshiba Silicone Co., Ltd.), followed by full stirring and filtration through a mesh. The filtrate was spin coated on an ITO electrode layer (with a thickness of about 500 Å and a resistance value of 80Ω/sq) provided on a glass substrate first at 4000 rpm for 2 seconds and then at gradually decreased revolutions per minute over a period of 30 seconds. After that, the product was heated in an oven of 150° C. for 1 hour for drying and curing, thereby forming on the ITO electrode a methyl-phenyl silicone varnish layer of 6 μm in thickness. Then, an insulating ink was coated on the varnish layer with a rectangular frame type of screen printing plate and dried to form a spacer having a thickness of 10 μm.

EXAMPLE 14

Two (2) % by weight of a curing catalyst ("CR-12" made by Toshiba Silicone Co.. Ltd.) diluted with n-butyl alcohol at a weight ratio of 1:1 were added to a 50% solution of methyl-phenyl silicone varnish in xylene ("TSR-144 made by Toshiba Silicone Co., Ltd.), followed by full stirring and filtration through a mesh. The filtrate was spin-coated on an ITO electrode layer (with a thickness of about 500 Å and a resistance value of 80Ω/sq) provided on a glass substrate first at 4000 rpm for 2 seconds and then at gradually decreased revolutions per minute over a period of 30 seconds. After that, the product was heated in an oven of 150° C. for 1 hour for drying and curing, thereby forming on the ITO electrode a methyl-phenyl silicone varnish layer of 6 μm in thickness. Then, a polyurethane adhesive ("Takenate" made by Takeda Chemical Industries, Ltd.) was coated on the methyl-phenyl silicone varnish layer in a striped pattern, and was further dried in an oven of 60° C. for 1 hour to form an adhesive layer of 3 μm in thickness. Then, a polyethylene terephthalate film was bonded to this adhesive layer. After aged in an oven of 60° C. for a further two days, the product was punched out with such a force as to keep the glass substrate intact by means of a punching die, while leaving the adhesive layer, whereby a portion of the unbonded film was removed to form a spacer.

EXAMPLE 15

Two (2) % by weight of a curing catalyst ("CR-12" made by Toshiba Silicone Co., Ltd.) diluted with n-butyl alcohol at a weight ratio of 1:1 were added to a 50% solution of methyl-phenyl silicone varnish in xylene ("TSR-144 made by Toshiba Silicone Co., Ltd ), followed by full stirring and filtration through a mesh. The filtrate was spin coated on an ITO electrode layer (with a thickness of about 500 Å and a resistance value of 80Ω/sq) provided on a glass substrate first at 4000 rpm for 2 seconds and then at gradually decreased revolutions per minute over a period of 30 seconds. After that, the product was heated in an oven of 150° C. for 1 hour for drying and curing, thereby forming on the ITO electrode a methyl-phenyl silicone varnish layer of 6 μm in thickness. Then, a polyurethane adhesive ("Takenate" made by Takeda Chemical Industries, Ltd.) was coated on the methyl-phenyl silicone varnish layer in a rectangular frame pattern, and was further dried in an oven of 60° C. for 1 hour to form an adhesive layer of 3 μm in thickness. Then, a polyethylene terephthalate film was bonded to this adhesive layer. After aged in an oven of 60° C. for a further two days, the product was punched out with such a force as to keep the glass substrate intact by means of a rectangular punching die, while leaving the adhesive layer, whereby an unbonded portion was cleared of the film to form a spacer.

EXAMPLE 16

A resin obtained by mixing a β-pinene polymer ("Picolight" made by Rika Hercules Co., Ltd.) with α-methylstyrene ("Crystalex 3085" made by Rika Hercules Co., Ltd.) at 1:1 was dissolved in xylene, and the resulting xylene solution was fully stirred, followed by filtration through a mesh. The filtrate was applied on a polyethylene terephthalate film (made by Mitsubishi Chemical Industries, Ltd.) by gravure reverse coating, followed by drying. A charge-carrying layer found to have a thickness of about 3 μm by gravimetric analysis was formed on the film. Then, a polyurethane adhesive ("Takenate" made by Takeda Chemical Industries, Ltd.) was gravure-coated on the charge-carrying layer and dried to form an adhesive layer of 3 μm in thickness. At the same time, a 10-μm thickness polyethylene terephthalate film was bonded to the adhesive layer. The rolled-up film, after aged in an oven of 60° C. for a further two days, was registered in position while leaving the adhesive layer, and was slit with such a force as to keep the support film intact by means of a slitter machine simultaneously with clearing an unbonded portion of the film, thereby forming a spacer.

By making a spacer for keeping a discharge gap constant integral with a electrostatic information recording medium, it is thus always possible to obtain a constant gap with no need of providing any additional spacer or without recourse to some awkward work involving providing a sensor for sensing a discharge gap and feeding back the resulting output to control the discharge gap. For continuous image pickup, only the electrostatic information recording medium need be supplied; high-speed image pickup is achievable. In addition, when a flexible substrate is used to roll up electrostatic information recording medium for storage, it is possible to prevent electrification due to the contact of the back side of the substrate with the surface of the charge-carrying layer or the stored electrostatic image from falling into disarray due to attenuation. Also, even when the electrostatic information recording medium in a flat or disc form are stacked up for storage, it is similarly possible to prevent the stored electrostatic charges from falling into disorder. This is true of when they are stored in a case, since the stored electrostatic charges cannot possibly come into contact with the inside of the case.

Reference will now be made to some embodiments wherein the electrode of at least one of a photosensitive member and a electrostatic information recording medium is provided in a patterned form and a spacer is located on an electrode-free region.

Figure 26:
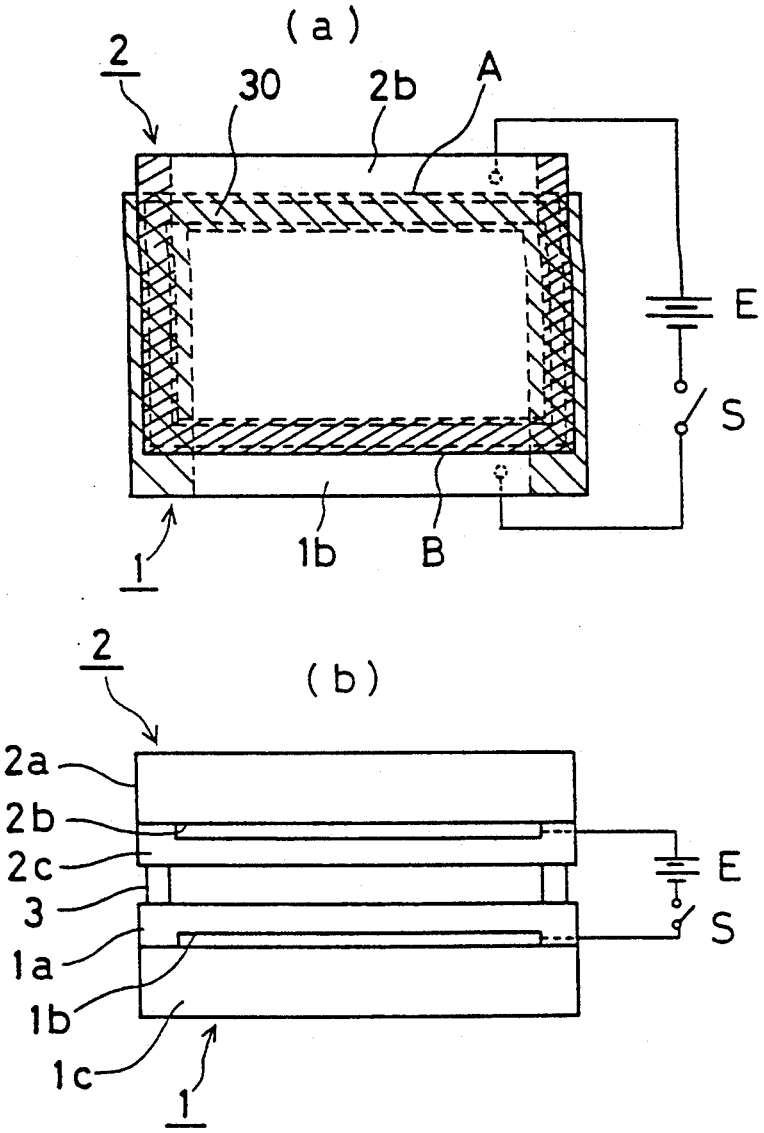
FIG. 26 is a diagrammatical sketch showing an example in which the electrode layers are provided on the photosensitive member and electrostatic information recording medium in patterned forms.

FIGS. 26*a* and 26*b* are plan and sectional views showing an electrostatic image recorder in which the electrode layers of photosensitive member and electrostatic information recording medium are provided, each in a patterned form.

As illustrated in the plan view presented as FIG. 26*a*, a photosensitive member 2 in a rectangular form, for instance, includes an electrode 2*b* on one side region with nothing on the remaining three side regions B (hatched regions). Likewise, electrostatic information recording medium 1 is provided with an electrode 1*b* on one side region with nothing on the remaining three side regions A (hatched regions). On the short sides their electrode-free regions overlap each other, whereas on the long sides their electrode-free regions are located in opposite relation without overlapping each other. A spacer 3 is then interposed between the photosensitive member 2 and the electrostatic information recording medium 1. It is understood that on the long sides their electrode-free regions may overlap each other, whereas on the short sides their electrode-free regions may be located in opposite relation without overlapping each other. The spacer 3, in a rectangular form, is positioned on the short sides at the electrode-free regions of the photosensitive member 2 and electrostatic information recording medium 1, and on the long sides at one of the electrode-free regions of the photosensitive member 2 and electrostatic information recording medium 1.

When high voltage is applied between the patterned electrodes of the photosensitive member and electrostatic information recording medium, no voltage is impressed on the spacer region; they are unlikely to be bruised, because neither surface current nor discharge breakdown is induced through the spacer. It is noted that all the four sides of the spacer need not be in contact with the photosensitive member or the electrostatic information recording medium. For instance, both its short or long sides may be positioned on the outside of the photosensitive member or the electrostatic information recording medium. In that case, patterning may be conducted such that no electrode is formed on at least one of the photosensitive member and electrostatic information recording medium at regions corresponding to the short or long sides.

EXAMPLE 17

A transparent electrode ITO ($In_2O_3$—$SnO_2$) on the side of a photosensitive substrate was etched in a patterned form. Patterning may be achieved by resist work such as photoresist work. In the instant example, however, patterning was conducted with a vinyl tape applied on the electrode for expediency. As the etchant, use was made of a mixed aqueous solution of ferric chloride and ferric sulfate. The photosensitive member used may be any desired type of material. In this example, however, 10-μm thickness a Se was used. An Al electrode on the side of electrostatic information recording medium was similarly etched, using 1N HCl as the etchant. The spacer used was a PET film.

Thus, the electrode layer of at least one of the photosensitive member and electrostatic information recording medium is cleared of the site on which the spacer is located; it is possible to prevent discharge breakdown which may otherwise be induced through the spacer and prevent the photosensitive member and electrostatic information recording medium from being bruised. It is also possible to decrease the capacitance of the overall system due to a decrease in the electrode area and hence relieve the amount of load born by an external circuit.

The present invention provides a technique for embodying image recording by the exposure process with the application of voltage, and is applicable to recording various images for the following reasons:

the amount of charges corresponding to the quantity of exposure can be obtained, the resulting image can be prevented from falling into disorder by inverse discharge, images of high accuracy can be obtained with no need of using any high-voltage external power source, the gap between the photosensitive member and electrostatic information recording medium can be easily keep constant, thus making it possible to conduct high-speed image pickup, and it is possible to prevent discharge breakdown which may otherwise be induced through a spacer, thereby increasing the service life of the photosensitive member and electrostatic information recording medium.

We claim:

1. An image-recording process wherein a photosensitive member including a photoconductive layer on a support through an electrode layer is located in opposite relation to electrostatic information recording medium including an insulating layer on a support through an electrode layer, and image exposure is then carried out while voltage is applied between the layers of the photosensitive member and the charge-carrying medium to accumulate charges on the electrostatic information recording medium in an imagewise form, characterized in that, after putting off said image exposure, the voltage applied between said electrode layers is put off after the lapse of duration, during which carriers generated by said image exposure reach said electrostatic information recording medium.

2. An image-recording process wherein a photosensitive member including an electrode layer and a photoconductive layer on a support is located in opposite relation to electrostatic information recording medium including an insulating layer on an electrode layer, and image exposure is then carried out to form an electrostatic latent image on the electrostatic information recording medium characterized in that either said photosensitive member or said electrostatic information recording medium has previously been charged to a given potential, and an electrical connection between both said electrode layers is put on-off for a given time duration for effecting in accordance with said exposure and said duration an electric field distribution between said photosensitive member and said electrostatic information recording medium for controlling said electrostatic latent image.

3. An image-recording system for continuously or intermittently feeding a film type of electrostatic information recording medium including an insulating layer on an electrode layer in opposite relation to a photosensitive member including an electrode layer and a photoconductive layer on a support and carrying out image exposure to form an electrostatic latent image on the film type of electrostatic information recording medium, characterized by further including means provided on the side of feeding said film type of electrostatic information recording medium for electrically charging said electrostatic information recording medium and means for putting on-off an electrical connection between said electrode layers of said electrostatic information recording medium and said photosensitive member at the time of said image exposure, thereby controlling said electrostatic latent image.

4. An image-recording system as claimed in claim 3, characterized in that said electrical charging is carried out by corona charging by the application of voltage, charging by friction or charging by releasing.

5. An image-recording system as claimed in claim 3, characterized by further including means for erasing a residual charge imaging on said photosensitive member.

6. An image-recording system including a turnable disk type of electrostatic information recording medium having an insulating layer on an electrode layer and a photosensitive member including an electrode layer and a photoconductive layer on a support, located in opposite relation there to carry out image exposure, thereby forming an electrostatic latent image on electrostatic information recording medium, characterized by further including means for electrically charging said disk type of electrostatic information recording medium and means for putting on-off an electrical connection between said electrode layers of said electrostatic information recording medium and said photosensitive member at the time of said image exposure, thereby controlling said electrostatic latent image.

7. An image-recording system as claimed in claim 6, characterized in that said electrical charging is carried out by corona charging by the application of voltage, charging by friction or charging by releasing.

8. An image-recording system as claimed in claim 6, characterized by further including means for erasing a residual charge imaging on said photosensitive member.

9. An image-recording system wherein a photosensitive member including an electrode layer and a photoconductive layer laminated successively on a substrate is located in opposite relation to electrostatic information recording medium including an electrode layer and an insulating layer laminated successively on a substrate through a spacer, and image exposure is carried out with the application of voltage between the electrode layers to form an electrostatic image on the insulating layer, characterized in that said electrode layer of at least one of said photosensitive member and said electrostatic information recording medium is provided in a patterned form, and said spacer is located on an electrode-free region.

10. A system for recording images, comprising a photosensitive member with an integrally built-in spacer, in which an electrode layer and a photoconductive layer are successively laminated on a substrate, said electrode layer being provided in a patterned form and said photoconductive layer being uniformly formed, and a spacer is provided on an electrode-free region of said photoconductive layer.

11. A system for recording images as claimed in claim 10, wherein said spacer is made of an organic or inorganic insulating material.

12. A system for recording images, comprising a photosensitive member with an integrally built-in spacer, in which:

an electrode layer and a photoconductive layer are successively laminated on a substrate, said electrode layer provided in a patterned form, and a spacer is provided on an electrode-free region, a region of said photoconductive layer, except said spacer region, being patterned and formed on said electrode layer with a thickness smaller than that of said spacer.

13. A system for recording images as claimed in claim 12, wherein said spacer is made of an organic or inorganic insulating material.

14. A system for recording images, comprising a photosensitive member with an integrally built-in spacer, in which an electrode layer and a photoconductive layer are successively laminated on a substrate, said electrode layer being uniformaly formed on said substrate, and a patterned spacer is formed on said electrode layer, said photoconductive layer being uniformly laminated on an electrode-free region of said electrode layer with a thickness smaller than that of said spacer.

15. A system for recording images as claimed in claim 14, wherein said spacer is made of an organic or inorganic insulating material.

16. A system for recording images, comprising a photosensitive member with an integrally built-in space, in which an electrode layer and a photoconductive layer are successively laminated on a substrate, said electrode and photoconductive layers being laminated on the bottom of a dent made in said substrate, and the total thickness of said electrode and photoconductive layers laminated being made smaller than the depth of said dent in said substrate to use a region of said substrate except said dent as said spacer.

17. A system for recording images as claimed in claim 16, wherein said spacer is made of an organic or inorganic insulating material.

18. A system for recording images, comprising a photosensitive member with an integrally built-in space, in which an electrode layer, an insulating layer and a photoconductive layer are successively laminated on a substrate and a patterned spacer is formed on said photoconductive layer.

19. A system for recording images as claimed in claim 18, wherein said spacer is made of an organic or inorganic insulating material.

20. A system for recording images, comprising electrostatic information recording medium with an internally built-in spacer, in which an electrode layer and an insulating layer are successively laminated on a substrate, a dent is made in said substrate, said electrode and insulating layers being laminated on the bottom of said dent with a total thickness smaller than the depth of said dent, and said spacer is defined by a region of said substrate except said dent.

21. A process for preparing electrostatic information recording medium with an integrally built-in spacer, comprising successively laminating an electrode layer and an insulating layer on a substrate, applying an adhesive in a patterned form on a region of said insulating layer on which no electrostatic image is to be formed, laminating an insulating film on the resulting adhesive layer, and then punching out an unbonded region of said film, thereby forming said spacer.

22. A process for preparing electrostatic information recording medium with an integrally built-in spacer, comprising successively laminating an electrode layer and an insulating layer on a substrate and providing said spacer on said insulating layer as an insulating, patterned layer, characterized in that an adhesive is applied in a patterned form on a region of said insulating layer on which no electrostatic image is to be formed and an insulating film is laminated on the resulting adhesive layer, and an unbonded region of said film is then punched out, thereby forming said spacer.

* * * * *